US006278365B1

(12) United States Patent
Kane et al.

(10) Patent No.: US 6,278,365 B1
(45) **Date of Patent: *Aug. 21, 2001**

(54) SECURITY SYSTEM WITH INTERMITTENT ALARM LOCATION DETECTION

(75) Inventors: Roger A. Kane, Alpharetta, GA (US); Glen D. Dell, Aurora, CO (US)

(73) Assignee: Protex International Corp., Bohemia, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/885,726

(22) Filed: Jun. 30, 1997

Related U.S. Application Data

(63) Continuation of application No. 08/441,925, filed on May 16, 1995, now Pat. No. 5,726,627.

(51) Int. Cl.[7] ..... G08B 1/00

(52) U.S. Cl. ..... 340/531; 340/506; 340/571; 340/572.1; 340/568; 340/825.36; 340/825.49

(58) Field of Search ..... 340/506, 571, 340/572.1, 568, 825.06, 825.36, 825.49, 505, 531, 508

(56) References Cited

U.S. PATENT DOCUMENTS

| | | | |
|---|---|---|---|
| 3,127,597 | 3/1964 | Lewin et al. | 340/538 |
| 3,253,270 | 5/1966 | Downer | 340/568.4 |
| 3,596,265 | 7/1971 | Garland | 340/568.2 |
| 4,293,852 | 10/1981 | Rogers | 340/568.1 |
| 4,573,041 | 2/1986 | Kitagawa et al. | 340/531 |
| 4,620,182 | 10/1986 | Keifer | 340/568.2 |
| 4,746,909 | 5/1988 | Israel et al. | 340/568.1 |
| 4,755,792 | 7/1988 | Pezzolo et al. | 340/538 |

(List continued on next page.)

FOREIGN PATENT DOCUMENTS

| | | |
|---|---|---|
| 1730092 | 3/1992 | (AU) . |
| 33 02 459 | 11/1983 | (DE) . |
| 33 43 436 | 2/1991 | (DE) . |
| 195 12 567 | 7/1996 | (DE) . |
| 196 12 374 | 8/1997 | (DE) . |

(List continued on next page.)

OTHER PUBLICATIONS

"Turtle Alarm", Se–Kure Controls, Inc., Chicago, IL (1993).
Se–Kure Controls, Inc. Catalog No. 194, Chicago, IL (Jan. 1994), pp. 7, 6, 4 and 2.
Se–Kure Controls, Inc. Catalog No. 894, Chicago, IL (Aug. 1994), p. 7.

(List continued on next page.)

*Primary Examiner*—Daryl Pope
(74) *Attorney, Agent, or Firm*—Collard & Roe, P.C.

(57) ABSTRACT

This invention provides a security system which remembers an alarm event until either the alarm event is intentionally reset or the condition causing the alarm event is corrected. The security system includes at least one sensor coupled to a hub and at least one hub. A serial chain of hubs is connected to a control unit having a controller. The controller sounding a main alarm when an alarm event is generated by the at least one sensor. After the main alarm is silenced and the security system is disarmed, the controller activates a hub annunciator of a hub connected to one of the sensors having generated an alarm event. When a predetermined period of time from disarming the security system expires, the controller sounds the main alarm if there are any alarm events that occurred during the predetermined period of time that are either not reset or the condition causing the alarm event is not corrected.

48 Claims, 19 Drawing Sheets

U.S. PATENT DOCUMENTS

| | | | |
|---|---|---|---|
| 5,003,292 | 3/1991 | Harding et al. | 340/568.4 |
| 5,066,942 | 11/1991 | Matsuo | 340/568.2 |
| 5,089,807 | 2/1992 | Shim | 340/568.2 |
| 5,153,567 | 10/1992 | Chimento | 340/691.5 |
| 5,172,098 | 12/1992 | Leyden et al. | 340/538 |
| 5,317,304 | 5/1994 | Choi | 340/571 |
| 5,341,124 | 8/1994 | Leyden et al. | 340/568.4 |
| 5,345,219 | 9/1994 | Rogers | 340/568.2 |
| 5,345,220 | 9/1994 | Wachsman | 340/568.4 |
| 5,379,023 | 1/1995 | Dalton | 340/568.8 |
| 5,543,782 | 8/1996 | Rothbaum et al. | 340/568.2 |
| 5,552,771 | 9/1996 | Leyden et al. | 340/571 |
| 5,561,417 | 10/1996 | Rothbaum et al. | 340/568.2 |
| 5,604,484 | 2/1997 | Rogers | 340/568 |
| 5,652,569 | 7/1997 | Gerstenberger et al. | 340/573.4 |
| 5,721,530 * | 2/1998 | Right et al. | 340/531 |
| 5,821,857 | 10/1998 | Rand | 340/568.8 |

FOREIGN PATENT DOCUMENTS

| | | |
|---|---|---|
| 0 116 701 | 12/1983 | (EP) . |
| 0 537 941 | 10/1992 | (EP) . |
| WO96/31852 | 10/1996 | (WO) . |
| WO97/31374 | 8/1997 | (WO) . |

OTHER PUBLICATIONS

"The Protex ProStrip," Protex International Corp., Bohemia, NY 11716, Jul. 8, 1994.

"Volumatic Star Trak" Brochure.

* cited by examiner

318

SECURITY SYSTEM WITH INTERMITTENT ALARM LOCATION DETECTION

This is a Continuation of application Ser. No. 08/441,925 filed May 16, 1995 now U.S. Pat. No. 5,726,627.

BACKGROUND

This invention generally relates to merchandise security systems.

Merchandise security systems are increasingly in demand due to the high cost of small and portable items such as tape players, video cameras and laptop computers, and the ease by which these items can be stolen from retailers. The majority of security systems protect items on display by adhering some form of sensor to the displayed items. Conventionally, a sensor is a simple switch having a protruding member which is depressed when the sensor is mounted onto the protected item, thus closing the switch. When a theft is attempted, the sensor is detached from the item thus opening the switch and causing an alarm to sound.

Some security systems connect sensors directly to a central unit while others group multiple sensors together for one location in a store and connect the grouped sensors to a local control box or a hub. For security systems having hubs, the sensors are wired to the hub using the hub cables through a jack. Each hub can accommodate multiple sensors. However, if less than the full capacity of sensors are connected to a particular hub, all unused sensor jack locations must be shunted via shunting plugs which emulate closed sensor switches.

The various hubs are connected to a central unit. When a sensor is activated, an alarm event is generated. The alarm event is detected by the control unit which causes the alarm to sound. When the alarm sounds, on some systems, a sensor indicator close to the sensor jack turns ON to indicate which sensor caused the alarm. After the alarm sounds, depressing the protruding member of the sensor generating the alarm event stops the sensor from generating further alarm events and turns the sensor indicator OFF, but the alarm is not stopped. The alarm can only be stopped by resetting the control unit.

Most conventional sensors utilize a switch which closes a sense loop when the sensor is attached to any flat surface. When the sensor is removed, the switch is opened, and the sense loop is opened causing an alarm event. This kind of sense loop scheme is susceptible to false alarms. A false alarm can occur, for example, when the plug connecting the sensor to the jack on the hub is temporarily misaligned causing the sensor to be temporarily disconnected from the hub. This disconnection opens the sense loop and is detected as an alarm event causing the control unit to set off the alarm, even though no theft is being attempted. In addition, the sensor indicator turns ON only when the sense loop is open. Accordingly, the sensor indicator turns ON and OFF intermittently for this kind of temporary disconnection. When the temporary misalignment recovers, the sensor indicator, if offered, turns OFF and all indications of the location of the misalignment are lost.

When a sensor is removed from a protected item, the sensor generates an alarm event because the sensor switch is open. A store attendant normally responds by disarming the alarm so that customers are not disturbed by the annoying alarm sound and notes the location of the sensor that caused the alarm as indicated by the sensor indicator, if offered. Then, the attendant determines whether the merchandise protected by the activated sensor has been stolen, or the sensor was compromised in some other manner. The store attendant corrects the alarm event condition by properly remounting the sensor onto the merchandise or disconnecting the sensor from the control unit if the sensor is damaged or defective. Only when the alarm event condition is corrected, can the security system be rearmed.

The above scenario is complicated by the occurrence of false alarms, such as misaligned jacks or improperly mounted sensors. When a false alarm of the intermittent variety occurs, the security system alarm is triggered. The store attendant goes through the normal steps attempting to locate and correct the cause of the alarm. However, since the cause of the alarm was only momentary, by the time the attendant reaches the control unit, the cause of the alarm has vanished and the sensor indicator, if offered, is OFF. Thus, the attendant is unable to identify the cause of the alarm. Since the alarm event no longer exists, the store attendant typically attempts to reset the control unit and if the system rearms, the store attendant assumes that only a false alarm had occurred.

This intermittent false alarm problem is exploited by shoplifters. The shoplifter first sets off the security system alarm by disconnecting a sensor from an article of merchandise. Then, after the alarm has sounded, the sensor is remounted onto the merchandise. When the store attendant checks for the location of the sensor causing the alarm, all the sensor indicators, if offered, are OFF. The store attendant assumes that the alarm was an intermittent false alarm and resets the control unit. Since the sensor was replaced by the shoplifter, alarm events are no longer generated and the security system alarm remains quiet.

Then, the shoplifter disconnects another sensor, causing a second alarm to sound, and again remounts the sensor back onto the merchandise. The store attendant again checks for the sensor that caused the alarm and, finding none, resets the control unit again thinking that another intermittent false alarm has occurred. This scenario is repeated several times until the store attendant simply assumes that the security system is too annoying to deal with, and turns the entire security system OFF. At this point, the shoplifter can steal any unprotected item from the previously protected and displayed items.

Further, a sensor plug can be removed from a hub and replaced by a shunting plug instead. The alarm will sound, even though none of the sensors have been removed from the protected merchandise. Since shunting plugs are normally used to shunt out unused jack locations, an attendant can easily overlook the additional shunting plug and rearm the control unit with the shunting plug replacing a sensor plug. The shoplifter is then free to remove the item previously protected by the now disconnected sensor.

SUMMARY OF THE INVENTION

It is an object of this invention to provide a security system which indicates the location of any sensor generating an alarm event even after the sensor stops generating the alarm event. In addition, shunting plugs are not used, so that the presence of a shunting plug on a hub immediately indicates tampering.

In order to achieve the above and other objects, this invention includes at least one sensor capable of detecting alarm events, at least one hub coupled to the at least one sensor and a control unit coupled to the at least one hub. A controller in the control unit activates at least one main alarm upon receiving alarm events detected by the at least one sensor and indicates a location of the at least one hub and the at least one sensor that originated the alarm events. The controller saves the location of the at least one hub and the at least one sensor in a memory for a predetermined period of time, while allowing immediate system rearm. The controller reactivates the at least one alarm after the predetermined period of time when a cause of the alarm events continues to persist.

The controller configures the security system by determining how many hubs are connected to the control unit. The controller also determines the number of sensors that are connected to each connected hub and the locations of each sensor. The controller adds new sensors to the configuration as additional sensors are plugged into any hub. However, if a sensor is removed, the controller will sound an alarm.

This invention also provides a method for operating the security system. The method includes mounting at least one sensor to objects to be secured. After all the sensors are mounted, the security system is configured and armed. The security system detects alarm events by polling the at least one sensor for alarm events and sounding the at least one alarm based on the alarm events. Upon sounding the at least one main alarm, the control unit displays the location of the alarm events. The controller of the security system silences the main alarm when a password is entered and permits the security system to be disarmed. The controller sounds the at least one main alarm again when a predetermined period of time has elapsed after the security system is rearmed unless conditions causing the alarm events have been corrected.

BRIEF DESCRIPTION OF THE DRAWINGS

The invention will be described in detail with reference to the following drawings, wherein.

DETAILED DESCRIPTION OF PREFERRED EMBODIMENTS

Figure 1:
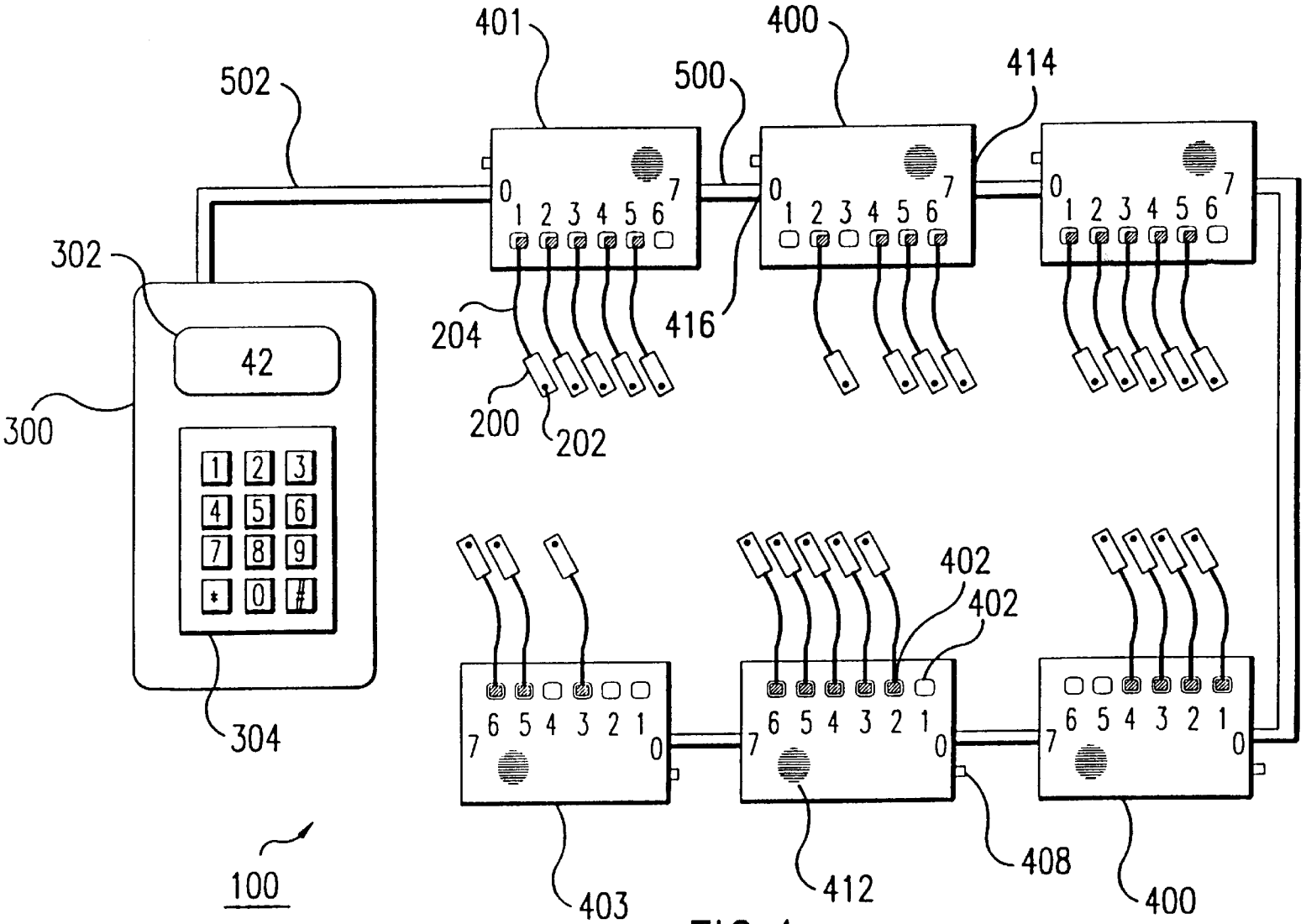
FIG. 1 is a diagram of the security system.

FIG. 1 shows a preferred embodiment for a security system 100. The security system 100 includes a control unit 300, a plurality of hubs 400 and a plurality of sensors 200 coupled to the hubs 400. Each sensor 200 may include an indicator 202, an LED for this embodiment, and a sensor cable 204. The sensor 200 is connected to a hub 400 by plugging the sensor cable 204 into a sensor jack 402. Each hub 400 includes a plurality of sensor jacks 402 . Each hub 400 also includes a hub/sensor location annunciator 412 and an upstream jack 416 and a downstream jack 414.

The downstream jack 414 is connected to another hub 400 by using hub connection cable 500. The hub connection cable 500 is connected between the downstream jack 414 of one hub 400 and the upstream jack 416 of another hub 400. In this manner a plurality of hubs 400 can be connected in a serial chain. The first hub 401 is connected to the control unit 300 by a control unit hub connection cable 502 connected to the upstream jack 416 of the first hub 401 and the control unit 300.

Figure 2:
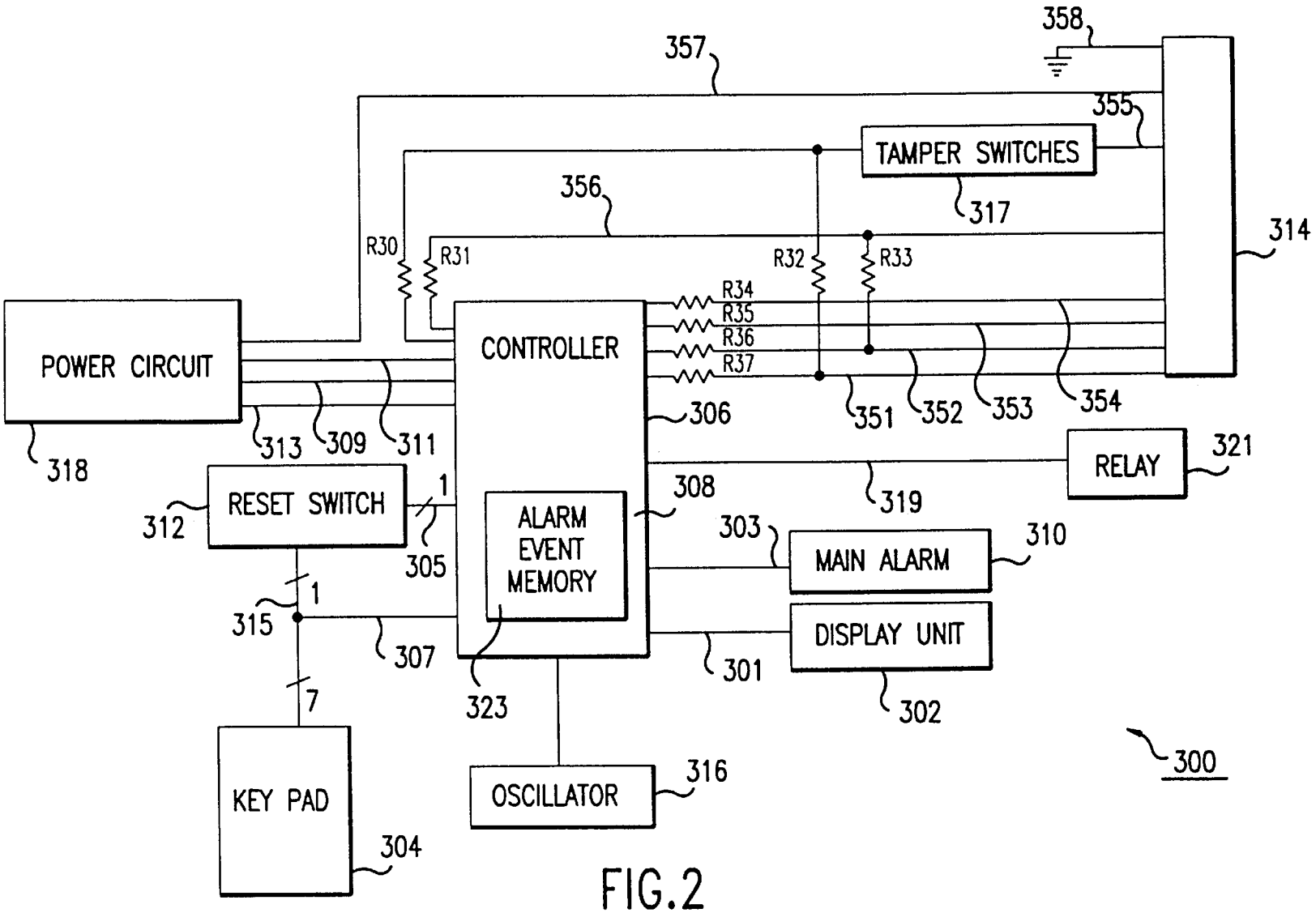
FIG. 2 is a block diagram of the control unit.

FIG. 2 shows a block diagram of the control unit 300 having a controller 308. The controller 308 detects alarm events generated by the sensors 200. An alarm event indicates an alarm condition. The controller 308 stores each alarm event into an alarm event memory 323. The contents of the alarm event memory 323 are carefully controlled by the controller 308 so that location information for each alarm event is provided when needed to correct alarm conditions causing the alarm events. The contents of the alarm event memory 323 are not reset unless an operator consciously does so and the alarm conditions causing the alarm events are corrected.

The controller 308 verifies the status of a power circuit 318 through signal lines 309 and 311. The signal line 309 indicates whether an external battery (not shown) is operational. The signal line 311 indicates whether a DC converter is supplying power to the security system 100.

Figure 3:
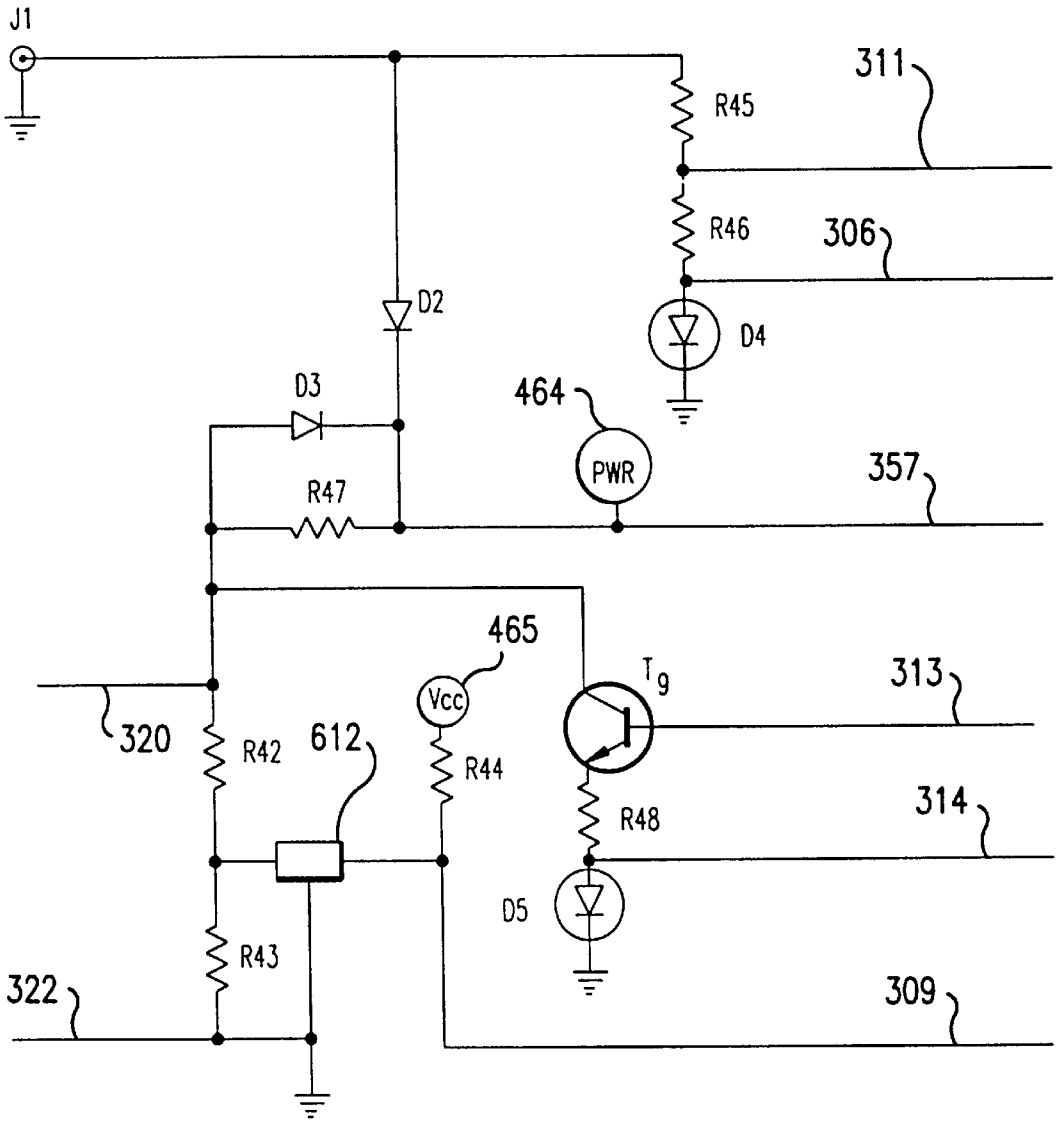
FIG. 3 is a schematic diagram of the power circuit shown in FIG. 2.

FIG. 3 shows a schematic diagram of the power circuit 318. Power is supplied to the power circuit 318 by the battery through power lines 320 and 322. Power line 320 is connected to the positive terminal of the battery and power line 322 is connected to the negative terminal of the battery and serves as a ground terminal for the power circuit 318. The condition of the battery is sensed by a battery voltage detector 612 through resistors R42 and R43. The battery voltage detector 612 outputs a low battery detection signal on signal line 309 to the controller 308. The signal line 309 is connected through a pull-up resistor R44 to a regulated supply voltage terminal 465. The regulated supply voltage value is $V_{cc}$. The power line 320 supplies power to the control unit 100 through diode D3.

The DC converter (not shown) supplies power to the security system 100 through jack J1. The power from the DC converter flows through the jack J1 through diode D2 onto power line 357. The diodes D2 and D3 prevent power from returning into the DC converter or the battery, respectively, so that a failure condition of either the DC converter or the battery will not drain power from the security system 100. The resistor R47 provides a trickle charge to the battery from the power line 357. Power from the power line 357 is distributed throughout the security system 100. The power terminal 464 indicates that power is supplied from the power line 357.

A signal line 306 is connected to the indicator D4 at the connection between the indicator D4 and the resistor R46.

The indicator D4 may be located close to a display unit 302. The indicator D4 indicates that the DC converter is supplying power to the security system 100.

The controller 308 detects that the DC converter is supplying power to the security system 100 through signal line 311. The DC converter drives the indicator D4 through resistors R45 and R46.

The controller 308 indicates that the security system 100 is armed by flashing indicator D5 through the signal line 313. The indicator D5 is driven by transistor T9 and connected to the signal line 313. The emitter of the transistor T9 is connected to ground through resistor R48 and the indicator DS while the collector is connected directly to the positive terminal of the battery through power line 320. When the signal line 313 is HIGH, the transistor T9 draws current from the power line 320 driving the indicator D5 through the resistor R48 turning the indicator D5 ON. However, if the battery is disconnected from the power line 320 or the battery voltage is low and the signal line 313 is HIGH, then the transistor T9 will lower the voltage sensed by the battery voltage detector 612 setting off a battery low signal on the signal line 309.

A signal line 314 is connected to the indicator D5 at the connection between the indicator D5 and the resistor R48. The D5 may be located close to the display unit 302.

The control unit 300 includes the display unit 302 and a keypad 304. Information such as passwords and commands are entered through the keypad 304. The control unit 300 displays the entered information as well as other data such as alarm event locations using the display unit 302.

FIG. 2 shows a conventional keypad 304 connected to the controller through signal line 307. The signal line 307 has 7 conductors accommodating four row signals and three column signals having numeric keys of 0–9, and an "*" and a "#". Depressing a key on the keypad connects a row signal to a column signal and is detected by the controller 308.

A reset switch 312 is also connected to the controller 308 through signal line 305. When the reset switch 312 is depressed, the keypad signal line 315 is connected with signal line 305 which signals the controller 308 to accept entries for new passwords without verification. The reset switch 312 is located in a protected location so that security is not compromised.

Figure 4:
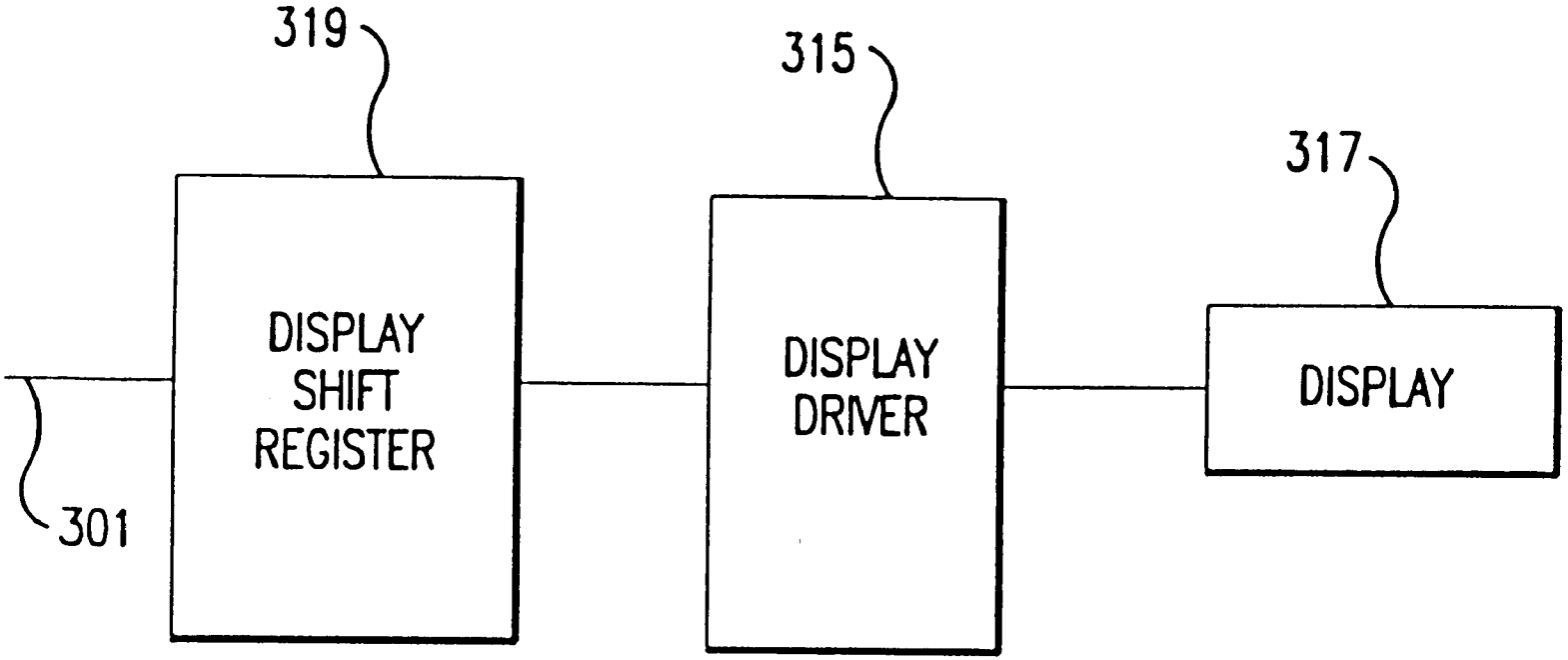
FIG. 4 is a block diagram of the display unit shown in FIG. 2.

The display unit 302 is connected to the controller 308 through signal line 301. As shown in FIG. 4, the signal line 301 is input to a display shift register 319. Commands from the controller 308 are serially shifted into the display shift register 319 which in turn outputs the commands in parallel to the display driver 315 which drives the display 317.

Figure 5:
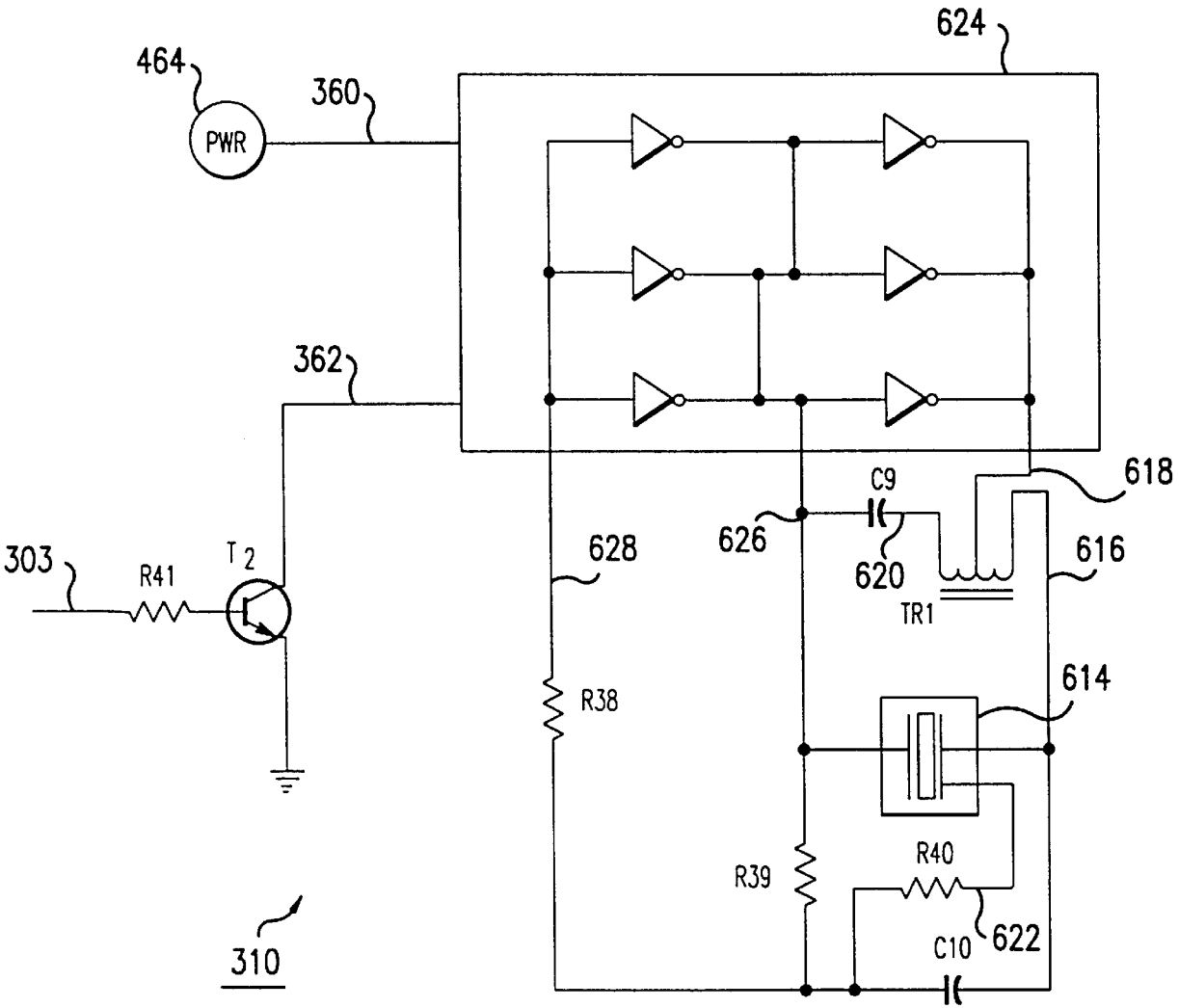
FIG. 5 is a schematic diagram of the main alarm shown in FIG. 2.

When an alarm event occurs, the controller causes the main alarm 310 to sound an alarm by a signal through signal line 303. FIG. 5 shows a schematic for the main alarm 310 which includes six logic inverters in one package 624 (inverter pack), a doubling transformer TR1 and an alarm unit 614. The six logic inverters are connected in parallel for greater current drive capability. The single package 624 of the six logic inverters are powered through power line 360 connected to the power terminal 464. The ground terminal of the inverter pack 624 is connected to ground line 362 which is switched to the ground through transistor T2. The transistor T2 is controlled by the controller 308 through signal line 303 and resistor R41. When the signal line 303 is LOW, the transistor T2 is turned OFF disconnecting the ground line 362 from the ground and preventing power from flowing through the inverter pack 624. Thus, when the signal line 303 is LOW, the alarm is turned OFF. When the controller 308 sets the signal line 303 to HIGH, the transistor T2 is turned ON and connects the ground line 362 to ground. Thus, when signal line 303 is HIGH, power flows into the inverter pack 624 through power line 360 and the main alarm 310 is turned ON.

The six inverters of the inverter pack 624 are separated into two groups. The first group of three inverters are connected in parallel with signal line 628 as input and signal line 626 as output. The second group of three inverters are also connected in parallel together with the signal line 626 as input and signal line 618 as output. Thus, the signal on the signal line 626 corresponds to the signal on the signal line 628 and 618 but inverted.

One end of the doubling transformer TR1 is connected to the signal line 620 which is coupled to the signal line 626 through capacitor C9. The center tap of the doubling transformer TR1 is connected to the signal line 618. Thus, half of the doubling transformer TR1 is driven by the second group of inverters. When the alarm is operating, the signal across the signal lines 616 and 620 is twice the amplitude as the signal across signal lines 618 and 620. Thus, the alarm unit 614 which is connected between the signal lines 616 and 620 through capacitor C9 receives twice the amplitude of the signal generated by the second group of inverters.

The signal line 622 is connected to a feedback terminal of the alarm unit 614. A feedback signal on signal line 622 which is connected to signal line 628 through resistors R40 and R38 provides positive feedback to the inverters of the inverter pack 624. When the transistor T2 switches the ground line 362 to ground, noise occurring at the input of the first group of inverters on the signal line 628 causes the six inverters of the inverter pack 624 to oscillate in conjunction with the alarm unit 614 generating an alarm. Capacitor C10 and resistor R39 are provided to limit the oscillation so that voltages do not reach levels harmful to the components of the main alarm 310 and to maintain oscillation only at the self-resonant frequency at the alarm unit 614.

FIG. 2 also shows a relay 321 connected to the controller 308. The controller 308 activates the relay circuit 321 through signal line 319. The relay 321 provides a normally closed and a normally open contacts so that external functions such as alerting a police station or activating other alarms can be controlled by the controller 308.

The controller 308 is connected to the first hub 401 through a control unit jack 314 which includes signal lines 351–358. The power circuit 318 supplies power to the hubs 400 through the power line 357. The ground line 358 supplies a common ground for all the hubs 400.

Signal lines 351 through 356 comprise the communication lines between the controller 308 and the hubs 400. Each of the control line 351–356 is buffered from the controller through resistors R30 through R37. These resistors R30–R37 protect the controller 308 from external shorts which may occur if one of the hub connection cables 500 or the cable 502 connecting the control unit 300 and the first hub 401 is cut.

A load signal and a clock signal are supplied by the controller 308 to the hubs 400 through signal lines 353 and 354. The controller 308 receives sensor data from a first hub 401 through signal line 356 and control data from the first hub 401 through signal line 355. The controller 308 outputs sensor data and control data through signal Lines 352 and 351, respectively.

Resistor R32 connects between the control data output signal line 351 and the control data input from the first hub line 355. This permits the controller 308 to detect that the cable 502 between the control unit and the first hub 401 has been cut. The resistor value R32 is selected so that when the cable 502 is not cut, the control data from the first hub 401 will be input to the controller through resistor R30 without being affected by the data that is on the control data output signal line 351. However, if the cable 502 is cut, then the control data output on signal line 351 is directly fed back to the controller 308 through resistor R32 and resistor R30. A similar connection is made for the sensor lines 352 and 356 through resistor R33 and R31.

The control unit 300 is disposed within a control unit box (not shown). Two tamper switches 317 protect the control unit box from unauthorized access. When the control unit box is closed, the tamper switches 317 are depressed allowing the signal line 355 to be connected to the controller 308 through resistor R30. However, when the control unit box is open, the tamper switches 317 disconnect signal line 355 from the controller 308. If the control unit box is opened without proper authority, the controller 308 will set off the main alarm 310.

The reset switch 312 is located inside the control unit box. Thus, the reset switch 312 cannot be used to enter a new password if the control unit box is closed. However, if the control unit box is opened without authority, the main alarm 310 is sounded. Accordingly, the only condition that the reset switch 312 can be used without activating the main alarm 310 to enter a new password is by opening the control unit box with proper authority.

Figure 6:
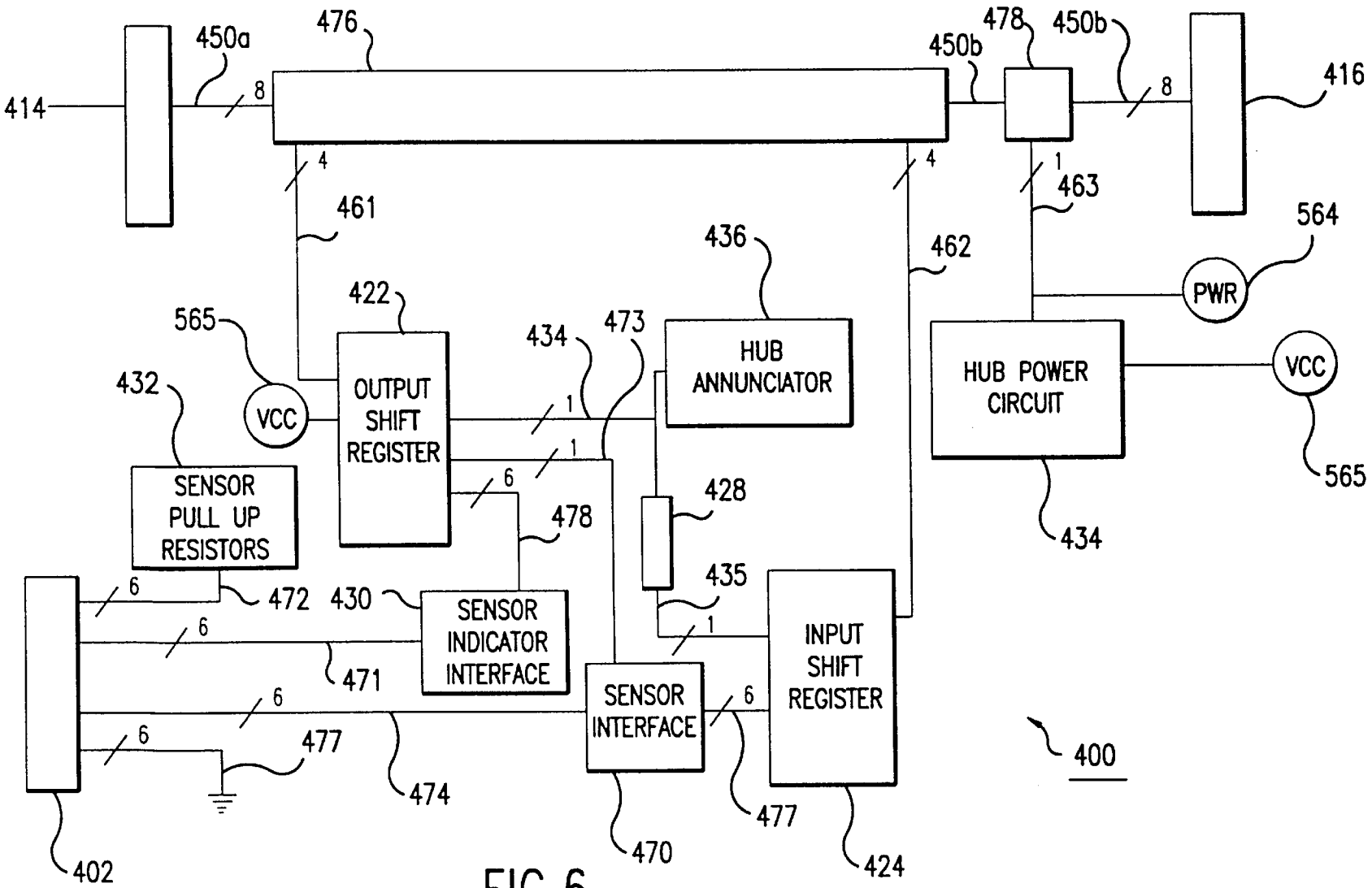
FIG. 6 is a block diagram of a hub shown in FIG. 1.

FIG. 6 shows a block diagram of the hub 400. Each hub 400 is connected with either the control unit 300 or a hub 400 through the upstream jack 416 and/or a hub 400 through the downstream jack 414. The last hub 403 is connected only to one other hub 400 through the upstream jack 416. Hubs 401 and 403 are identical to the hubs 400. The only exceptions are that the hub 401 is connected to the control unit 300 and the hub 403 is the last hub 403 in the chain of hubs 400. Accordingly, all reference to hubs 400 also apply to the hubs 401 and 403.

Each hub 400 has an output shift register 422, an input shift register 424, and a hub annunciator 412. The hub 400 is connected to the sensors 200 through sensor jacks 402. Each sensor jack 402 is provided with a sensor pull up resistor 432 through signal lines 472. The sensor indicator 202 is controlled by the output shift register 422 through signal line 478 which is coupled to the sensor indicator 202 through a sensor indicator interface 430 over signal line 471. An alarm event from each sensor 200 is detected on signal line 474 through the sensor interface 470 which is connected to the input shift register 424 over signal line 477. Each sensor 200 is also supplied with a ground line 479.

The hub annunciator 412 is reset by reset switch 428 through signal line 434. The reset switch 428 is connected to the input shift register 424 through signal line 435. The reset switch 428 does not directly reset the hub annunciator 412, but sends a signal to the controller 308 that the reset switch 428 is activated. The controller 308 turns off the hub annunciator 412 when all the requirements for turning OFF the hub annunciator 412 are met as will be described later.

Figure 7:
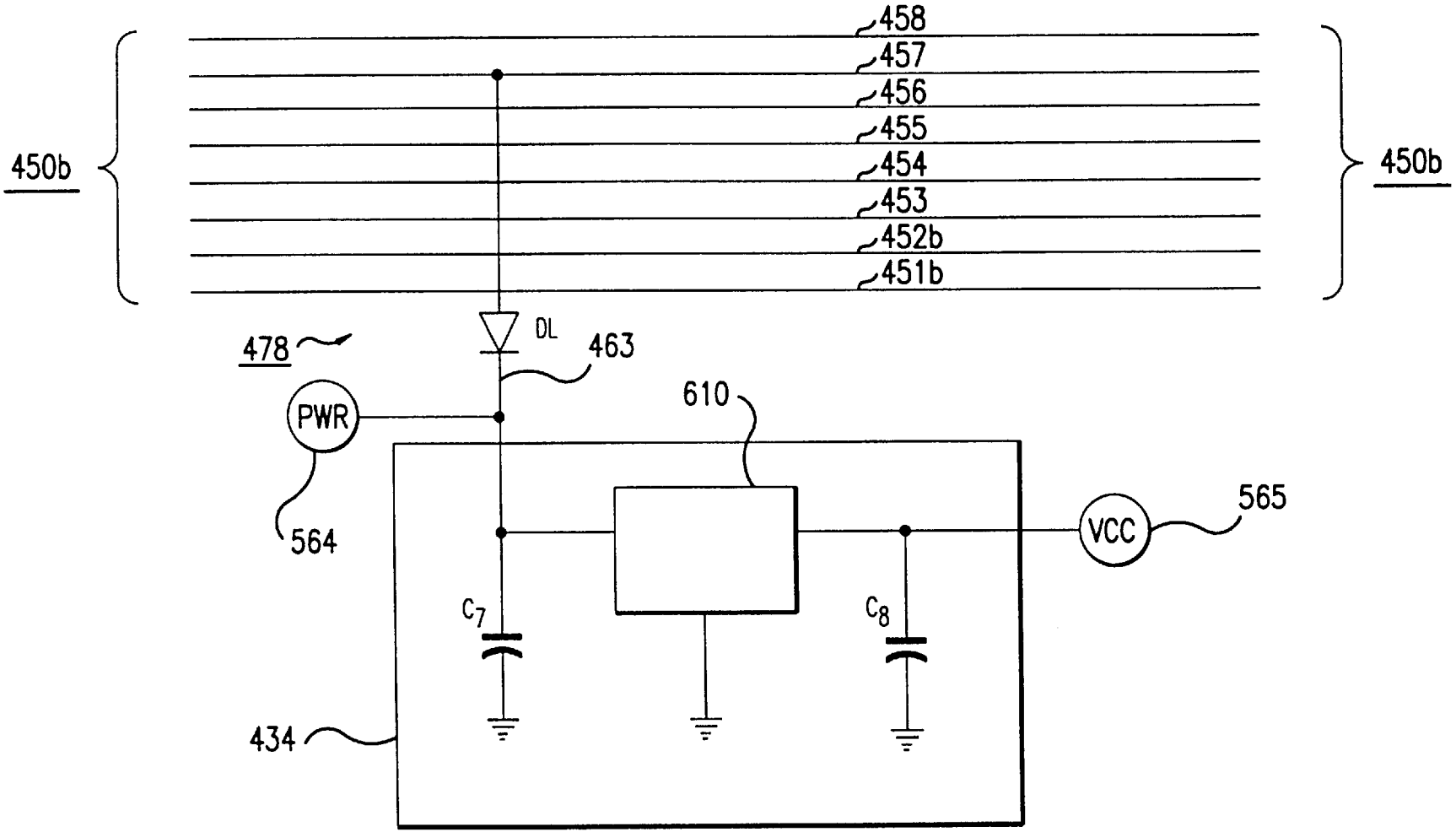
FIG. 7 is a schematic diagram of the power circuit shown in FIG. 6.

The hub 400 receives power from the upstream jack 416 through a hub power circuit 434. As shown in FIG. 7, the hub power circuit 434 receives power from line 457 which is derived directly from the upstream jack 416. Power is input into the hub through diode D1. The cathode of the diode D1 is connected to capacitor C7 and voltage regulator 610 through power line 463. The power from the power line 463 is distributed directly to the rest of the hub 400 by connecting to power terminal 564. The regulator 610 outputs a regulated supply voltage $V_{cc}$ onto supply voltage terminal 565. The regulated supply voltage $V_{cc}$ is stabilized by capacitor C8. Elements of the hub 400 receives regulated power by simply connecting to the supply voltage terminal 565.

The output and input shift registers 422 and 424 are connected to the upstream jack 416 and downstream jack 414 through connection block 476. The output shift register is connected to connection block 476 through signal line 461 and the input shift register 424 is connected to the connection block 476 through signal line 462.

Figure 8:
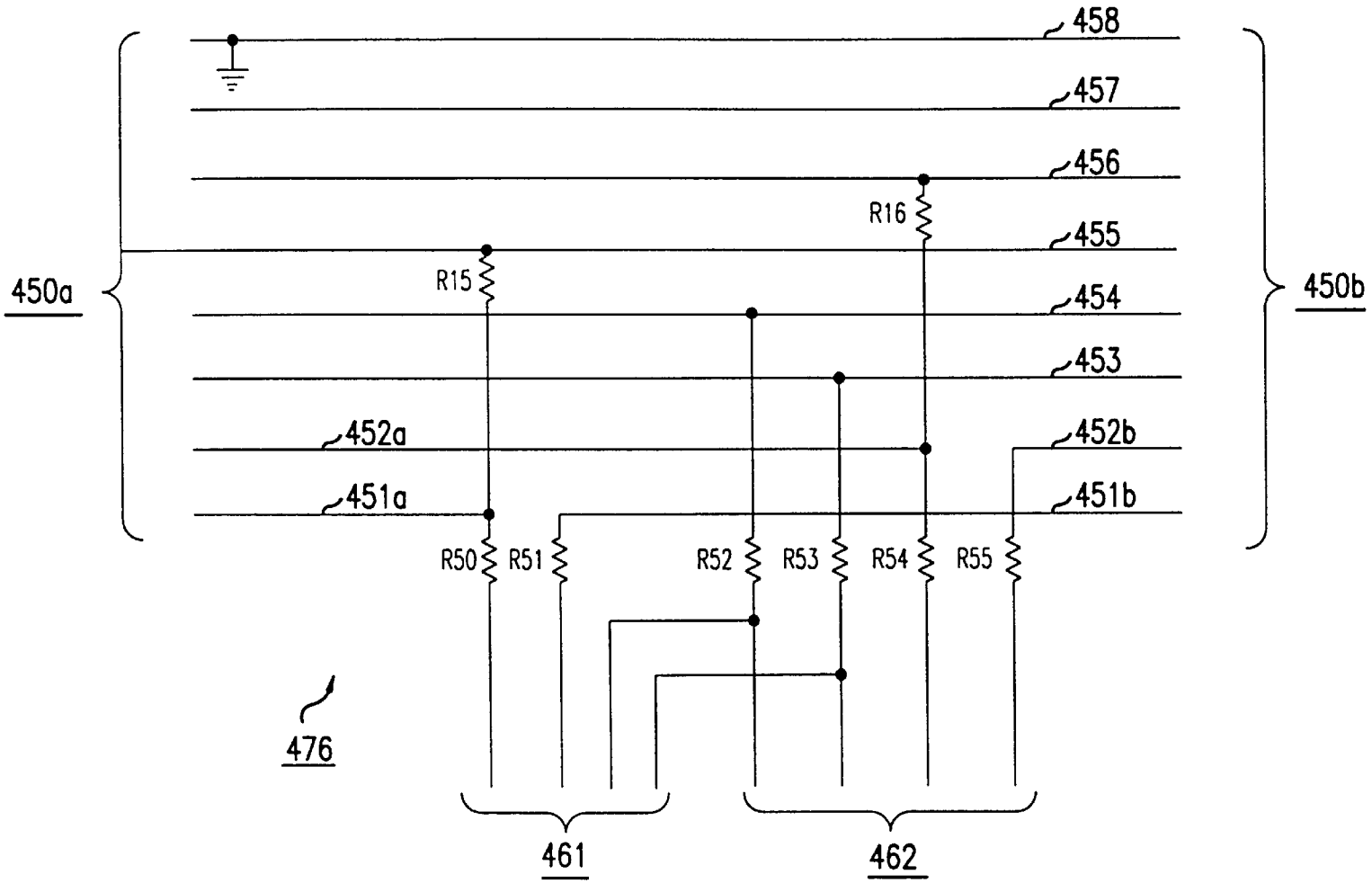
FIG. 8 is a schematic diagram of the connection block 476 shown in FIG. 6.

FIG. 8 shows that the output shift register 422 is connected directly to the load signal line 453 and clock signal line 454 through resistors R53 and R52, respectively. The control data output from either the control unit 300 through the signal line 451 and R15 or a downstream hub 400 is input to the output shift register 422 through signal line 455*b* and resistor R51. Control data is output from the output shift register 422 to an upstream hub 400 or the control unit 300 through signal line 455*a* and resistor R50.

The load and clock signals on the signal lines 453 and 454 are input into the input shift register 424 through resistors R53 and R52, respectively. The sensor data are output from either the control unit 300 through the signal line 452 and R16 or a downstream hub 400 through signal line 456*b* and resistor R55. The input shift register 424 outputs sensor data to an upstream hub or the control unit 300 through signal line 456*a* and R54. The control data signal line 455*b* on the last hub 403 receives the control data from the control unit 300 on signal line 451 through resistor R15. The sensor data signal line 456*b* on the last hub 403 receives the sensor data from the control unit 300 on signal line 452 through resistor R16. R15 and R16 allow the control data and the sensor data to be received from the control unit 300 even if the hub connection cable 500 connecting the downstream jack 414 to a downstream hub 400 has been cut.

Figure 9:
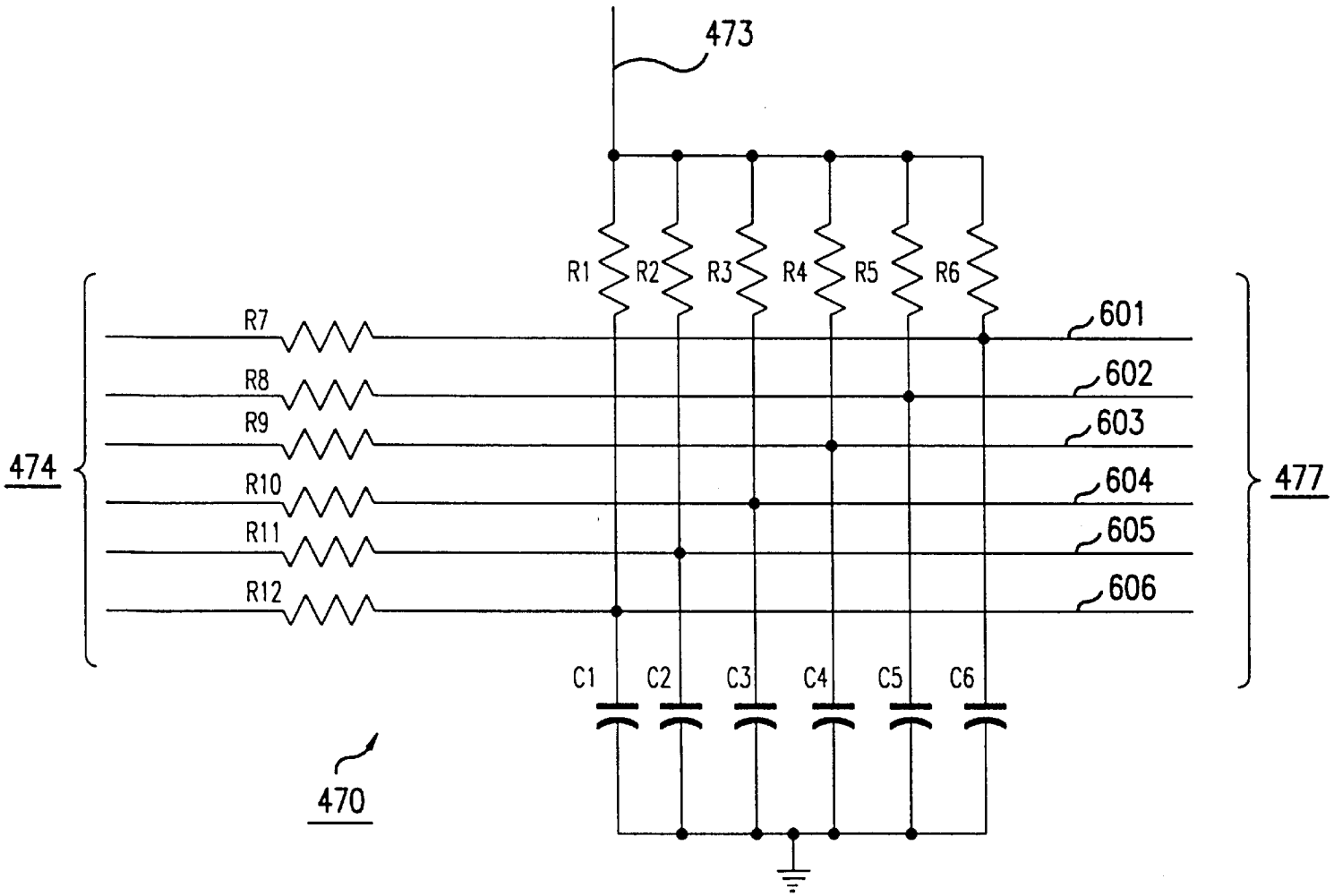
FIG. 9 is a schematic diagram of the sensor interface shown in FIG. 6.

FIG. 9 shows a circuit diagram for the sensor interface 470. The sensors 200 for each hub 400 are connected to the input shift register 424 on signal lines 601–606 through series resistors R7–R12, respectively. The signals on signal line 474 are filtered by capacitors C1–C6. Resistors R1–R6 are used to charge the capacitor C1–C6 immediately after power on. After the capacitor C1–C6 are charged, resistors R1–R6 serve as pull-down resistors to drain the capacitors C1–C6 when either the sensors 200 are disconnected from the hub 400 or when the sensors 200 detect an alarm event.

The control unit 300 first shifts into the output shift register 422 a value setting the signal line 473 to HIGH. When the signal line 473 is HIGH the capacitor C1–C6 are charged through resistors R1–R6, respectively. After the capacitors C1–C6 are charged, the controller 308 shifts into the output shift register 422 a value setting the signal line 473 to LOW. When the signal line 473 is LOW, resistors R1–R6 drain the capacitors C1–C6 unless the sensor switches are closed connecting sensor pull-up resistors 432 to the signal line 474.

Figure 10:
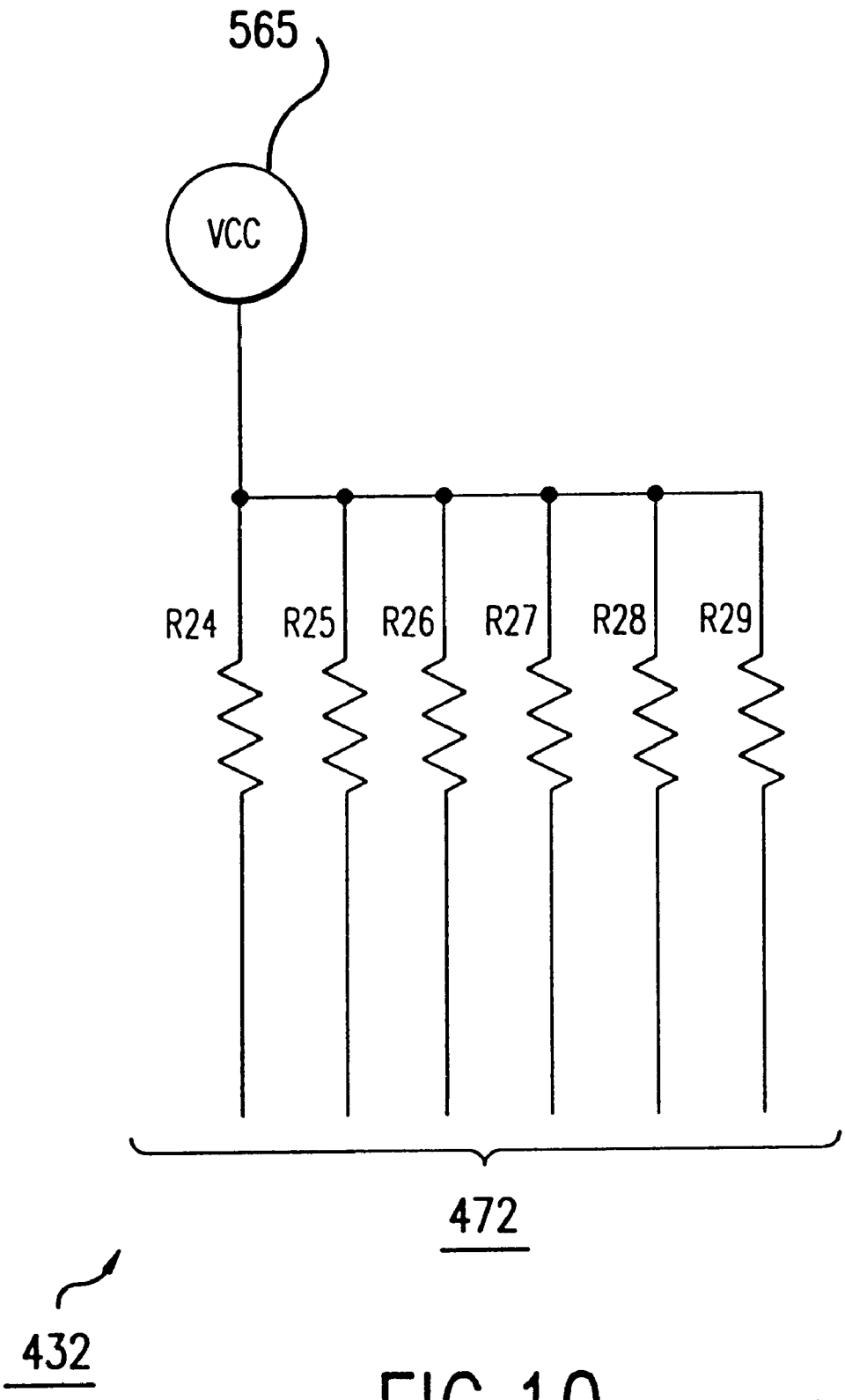
FIG. 10 is a schematic diagram of the sensor pullup resistors shown in FIG. 6.

FIG. 10 shows a schematic of the sensor pull-up resistors 432. Resistors R24–R29 connect each of the sensor switches to the supply voltage terminal 565.

Figure 11:
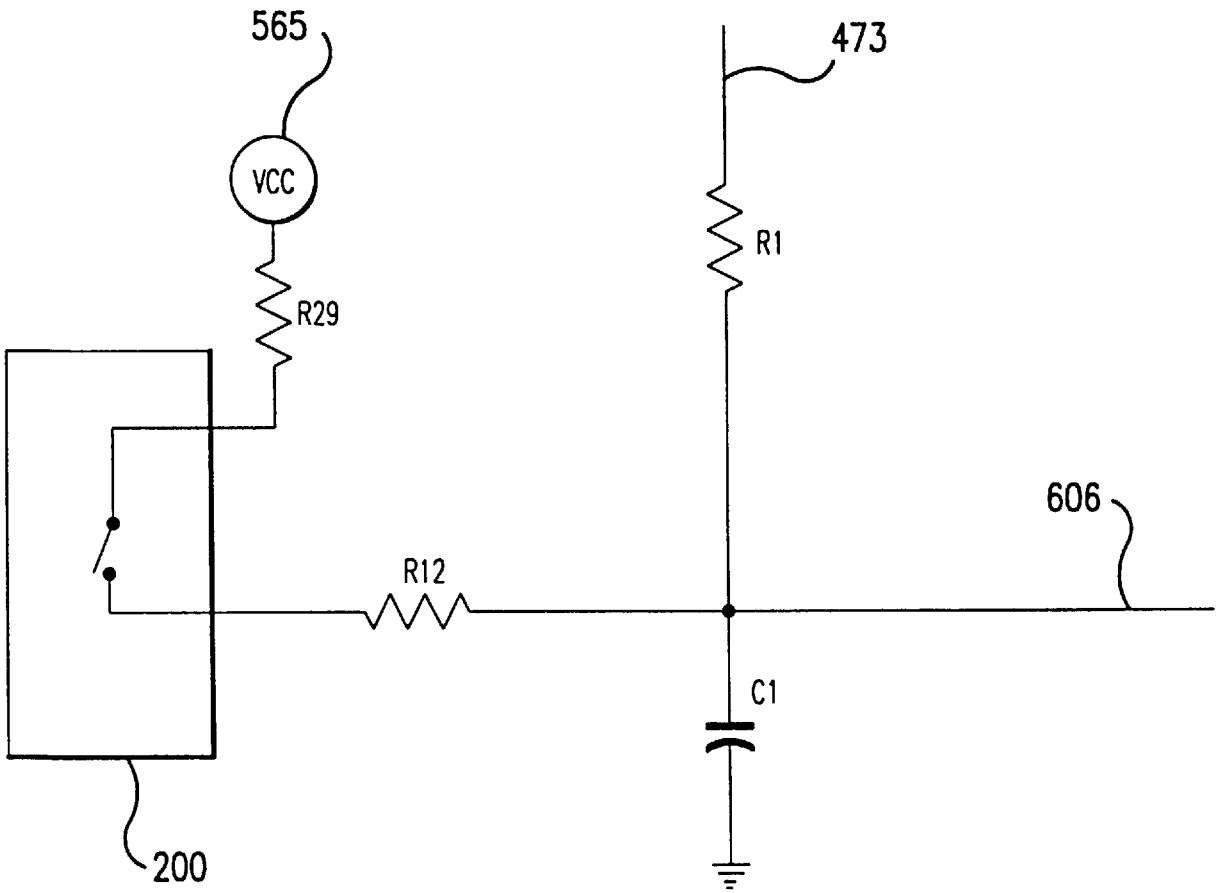
FIG. 11 is a schematic diagram of a sensor loop.

FIG. 11 shows a complete sensor circuit connected to signal line 606 of the input shift register 424. Immediately after power ON, signal line 473 is set to HIGH. When signal line 473 is HIGH, the capacitor C1 is charged through R1. After the capacitor C1 is charged, the signal line 473 is set to LOW. When the signal line 473 is LOW, resistor R1 is effectively grounded and the capacitor C1 is charged through the sensor pull-up resistor R29 through resistor R12. The values of the resistors R1, R12 and R29 are set such that the signal on signal line 606 is HIGH. When the sensor 200 detects an alarm event, the sensor switch is opened and disconnects resistor R29 from resistor R12. In this condition, the capacitor C1 is discharged through resistors R1 setting the signal line 606 to LOW. When the LOW signal on the signal line 606 is shifted back to the controller 308, the controller 308 will sound the main alarm 310. This sensor circuit will operate similarly if the sensor switch resistor temporarily shorts the sensor switch connection to resistor R12 to ground. The values of resistor R12 and capacitor C1 are set so that a momentary pulse to ground is detected.

Figure 12:
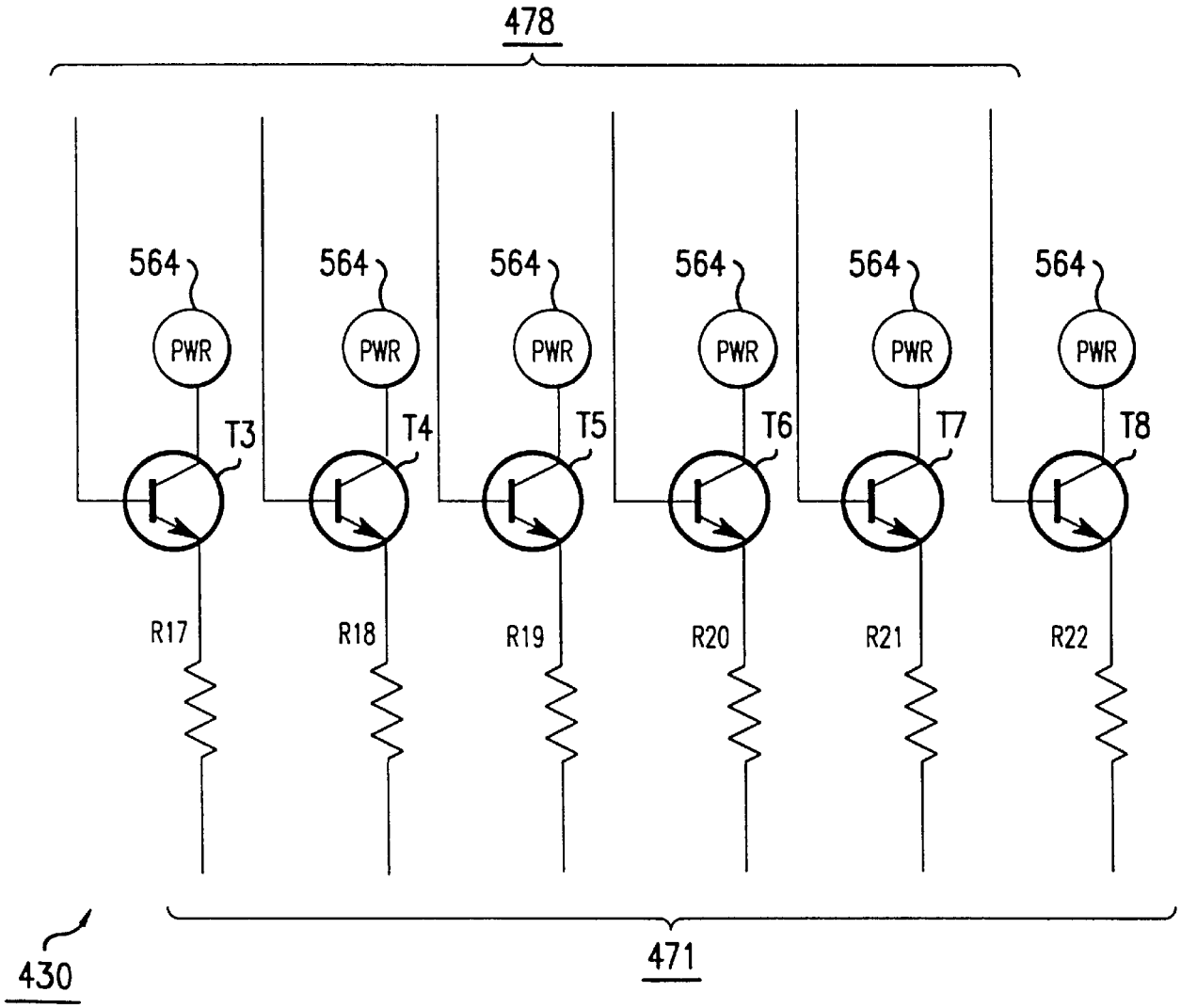
FIG. 12 is a schematic diagram of the sensor indicator interface shown in FIG. 6.

FIG. 12 shows the sensor indicator drive 430. Sensor indicators 202 are driven by transistors T3–T8 through resistors R17–R22. The controller 308 controls the lighting of the sensor indicator 202 by shifting control bits into the output shift register 422 setting the values of the signals on signal line 478. When the corresponding signal of signal line 478 is HIGH, the respective transistors T3–T8 drive the sensor indicators 202 through the corresponding resistor R17–R22 turning the respective indicator ON. When the signal on the signal lines 478 is LOW, the corresponding transistor T3–T8 stops driving the sensor indicator 202 turning OFF the corresponding sensor indicator 202.

The sensor indicators 202 indicate that the sensors 200 are connected to the hub 400 and are flashed a number of times corresponding to the jack location on the hub 400. The sensor indicators 202 can be turned OFF for various reasons such as conserving battery power and, in the case where no sensor indicators 202 are provided, no indications are provided at the sensors 200.

Figure 13:
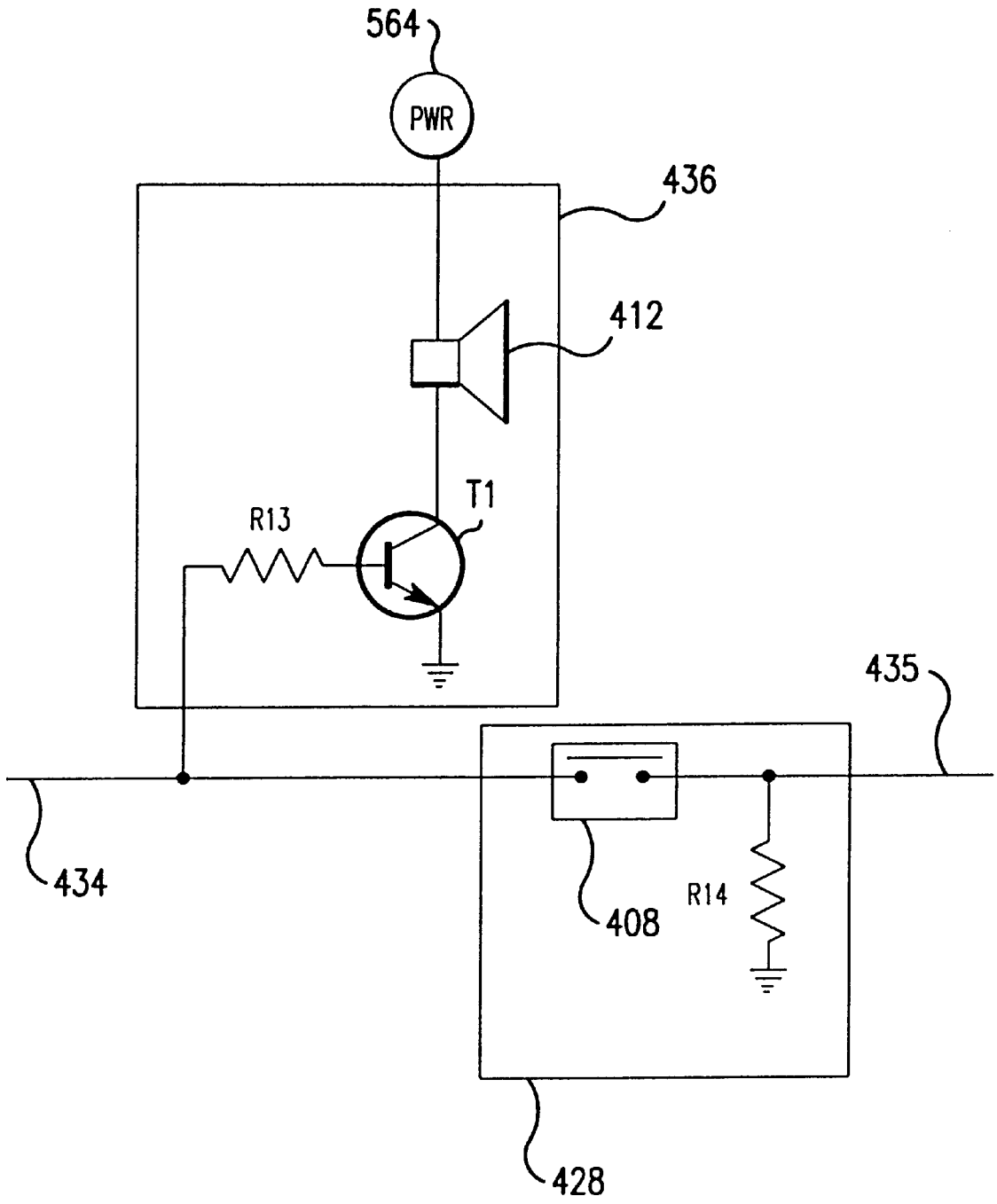
FIG. 13 is a schematic diagram of the hub alarm shown in FIG. 6.

FIG. 13 shows a circuit diagram of the hub annunciator 412 and a circuit for the switch 428. The controller 308 issues an annunciation command by setting the signal line 434 to HIGH. The transistor T1 is turned ON through resistor R13. When the transistor T1 is ON, power is input to the piezoelectric/speaker 412 thus annunciating a tone.

When the hub annunciator 412 is activated and the hub reset switch 408 is depressed, the hub reset switch 408 connects signal line 434 to signal line 435. Normally when the hub reset switch 408 is open, the signal line 435 is maintained at LOW by resistor R14. However, when the signal line 434 is HIGH and the switch 408 is depressed, the signal line 435 is set to HIGH. The signal on the signal line 435 is input to the input shift register 424. The controller 308 reads the value of the signal on the signal line 435 by shifting the input shift register 424. If the security system 100 has been disarmed after an alarm is sounded and a time delay has elapsed, then a HIGH on the signal line 435 will cause the controller 308 to set the signal on the signal line 434 to LOW turning off the hub annunciator 412.

The indications D4 and D5 and the sensor indicator 202 may be implemented using LEDs. Any other type of indicators may also be used without affecting any aspects of the invention.

TABLE 1

| DISPLAY | SYSTEM OPTION |
|---|---|
| P0 | Continuous Main Alarm Tone |
| P1 | Pulsed Main Alarm Tone |
| A0 | Key Pad Alarm Reset Disabled |
| A1 | Key Pad Alarm Reset Enabled |

TABLE 1-continued

| DISPLAY | SYSTEM OPTION |
|---|---|
| 0L | Sensor Indicator Disabled |
| 1L | Sensor Indicator Enabled |
| 0A | DC Converter Failure Detection Disabled |
| 1A | DC Converter Failure Detection Enabled |

Table 1 shows the system options that can be set by entering the information through the key pad 304. The left column of Table 1 shows the characters that are displayed on the display unit 302.

The main alarm 310 of the security system 300 can be optionally set to sound in a continuous alarm tone or to sound in a pulsed alarm tone corresponding to displays P0 and P1, respectively. After an alarm is sounded and the control unit 300 is reset, the hub annunciator 412 is activated. The hub annunciator 412 indicates the jack location of the sensor that generated the alarm event by sounding a number of times equal to the sensor jack number, synchronized to the flashing of the indicator 202. The hub annunciator 412 can be reset by pushing the reset button 408 on the hub 400. However, an option is provided to reset the hub annunciator 412 using the key pad 304 on the control unit 300 instead. The display unit 302 displays A0 or A1 corresponding to the keypad alarm reset option being disabled or enabled, respectively.

The security system 300 also provides an option to enable or disable the sensor indicator 202 for each sensor 200. When the sensor indicator is enabled, the control unit 308 flashes each sensor indicator the number of times equal to the sensor jack number of that sensor. When the sensor indicator is disabled, the controller 308 turns all sensor indicators OFF. The display unit 302 displays 0L or 1L corresponding to the sensor indicator being disabled or enabled, respectively.

TABLE 2

| DISPLAY | SYSTEM OPTION |
|---|---|
| — | Reconfiguration Enabled |
| 00 | Tamper Switch Open |
| 07 | No Hubs Connected |
| <h>7 | Hubs <h> and following are missing; <h> is Hub Number |
| LP | Battery Power is low |
| AP | DC converter not Operating or Connected |
| <h><s> | Alarm Event at <h> Hub Number <s> = Sensor Number |
| L<c> | Password Digit <c>; <c> is a number from 0–9 |
| L- | Waiting for First New Password Number |

The security system 300 also provides the option to disable or enable the DC converter failure detection mechanism. When the DC converter failure detection mechanism is enabled, the controller 308 senses the status of the DC converter through signal line 311. If the controller 308 detects that the DC converter is not operating, the controller 308 indicates the alarm event by sounding the main alarm 310. The display unit 302 displays 0A or 1A corresponding to the DC converter failure detection being disabled or enabled, respectively.

Table 2 shows the characters displayed on the display unit 302 for a plurality of system conditions. When the controller 308 detects no alarm conditions either currently or during a previous predetermined period of time, the controller 308 indicates that the security system may be reconfigured by displaying two dashes "--" on the display unit 302.

When the controller 308 detects that the tamper switches 317 are open, the main alarm 310 is sounded and the display unit 302 displays "00." The tamper switches 317 protect the control unit box from being opened without proper authorization.

When the first hub 401 is disconnected from the control unit 300, the controller 308 sounds the main alarm 310 and displays "07" on the display unit 302. When the controller 308 detects that other hubs 400 are missing, the controller 308 sounds the main alarm 310 and displays the number of the hub 400 followed by a "7". Since the hubs 400 are connected in a serial chain from the control unit 300 to the last hub 403, the hub number is the position of the hub starting with 1 corresponding to the first hub 401.

When the controller 308 detects that the battery is not operating or the voltage has dropped below a predetermined level, the controller 308 displays "LP" on the display unit 302. When the controller 308 detects that the DC converter is not operating, the controller 308 displays "AP" on the display unit 302.

When the controller 308 detects alarm events, the controller 308 displays the hub number and the sensor number having generated the alarm event. Thus, if the sensor 200 connected to sensor jack 2 of hub 4 detected an alarm event, the controller 308 displays "42" on the display unit 302. If more than one sensor 200 detects an alarm event, the sensors 200 connected to the lowest hub number having the lowest jack number is displayed first. After the alarm event condition for the first displayed sensor is acknowledged, the controller 308 displays the next sensor 200 that detected an alarm event. This process continues until all the alarm event conditions have been acknowledged.

The controller 308 provides a method for entering a new password. When receiving a new password, the controller 308 displays an "L" followed by a number that is entered through the keypad 304. When the password entry process begins, the controller 308 first displays "L-" indicating that the controller 308 is waiting for the first digit of the new password.

Figure 14:
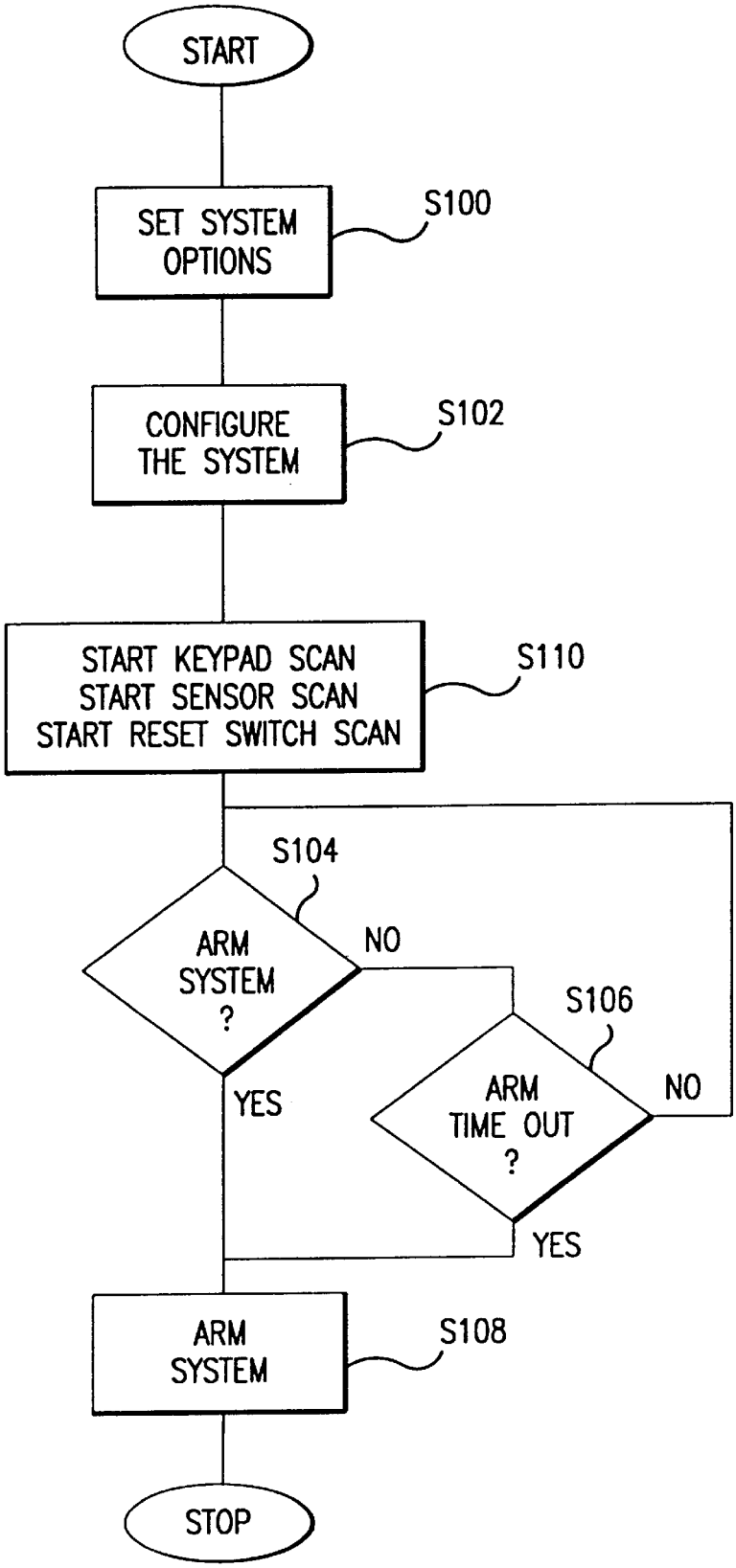
FIG. 14 is flowchart of the power ON process of the security system.

FIG. 14 shows a flow chart of the controller 308 process after the security system 300 is powered on. After power on, the controller 308 goes to step S100. In step S100, the controller 308 sets the password to "0000". The controller 308 enables the pulsed tone option for the main alarm 310, disables the keypad reset option, disables the sensor indicator option and disables the DC converter failure detection option. Then the controller 308 continues to step S102.

In step S102, the controller 308 configures the security system 100. The controller 308 configures the security system 100 by determining all the hubs 400 that are connected to the control unit 300. Then, the controller 308 determines all the sensors 200 that are connected to each hub 400. The controller 308 stores the system configuration comprising all the hubs and sensors in a controller memory (not shown) which enables the controller 308 to detect when a sensor 200 or a hub 400 is removed from the security system 100. However, if new hubs 400 or new sensors 200 are added to the system, the controller 308 automatically updates the system configuration to account for the additional hubs and sensors 400 and 200, respectively. After configuring the system, the controller 308 continues to step S110.

Figure 15:
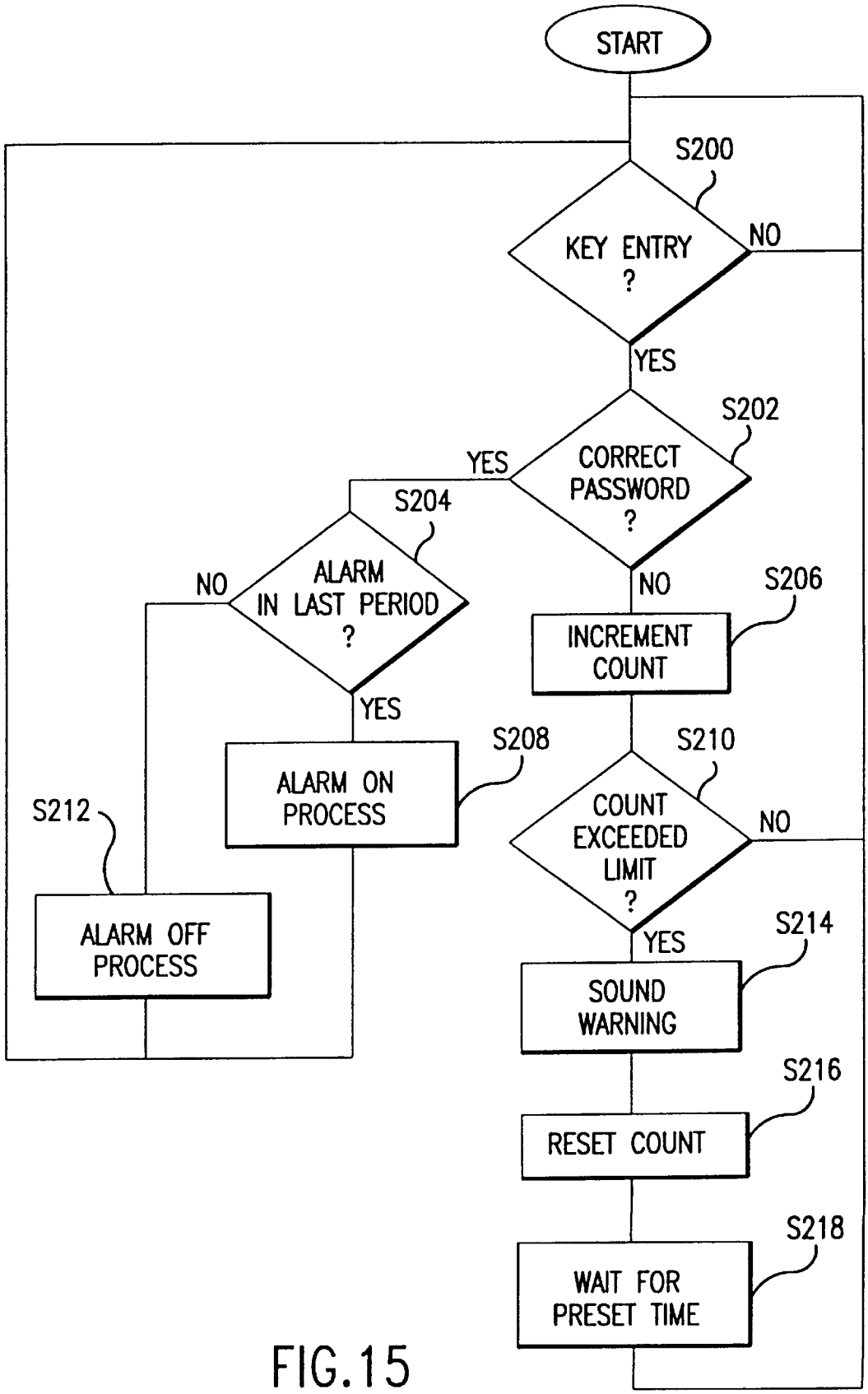
FIG. 15 is a flowchart of the key entry process.
Figure 18:
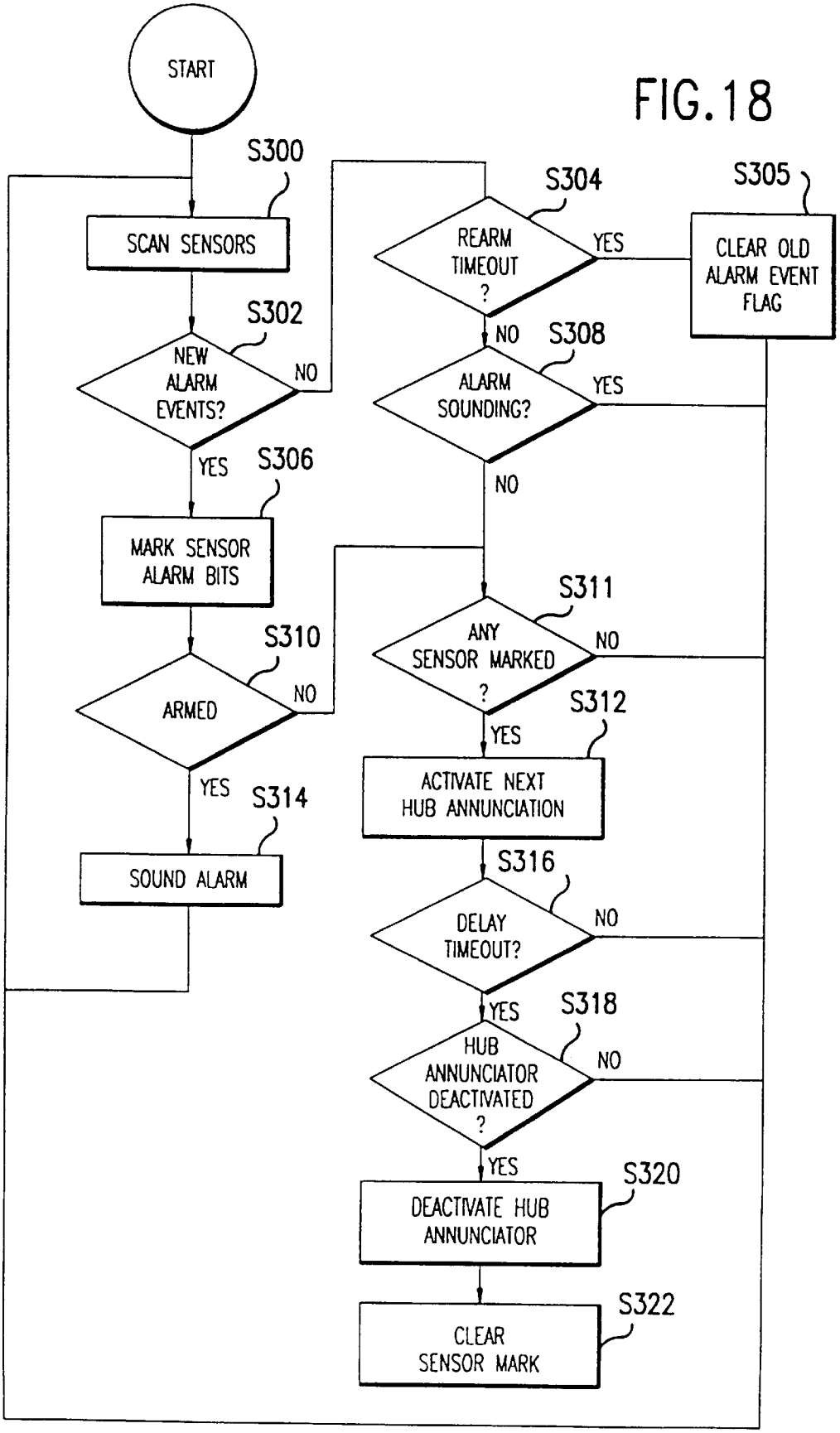
FIG. 18 is a flowchart of the sensor scan process.
Figure 19:
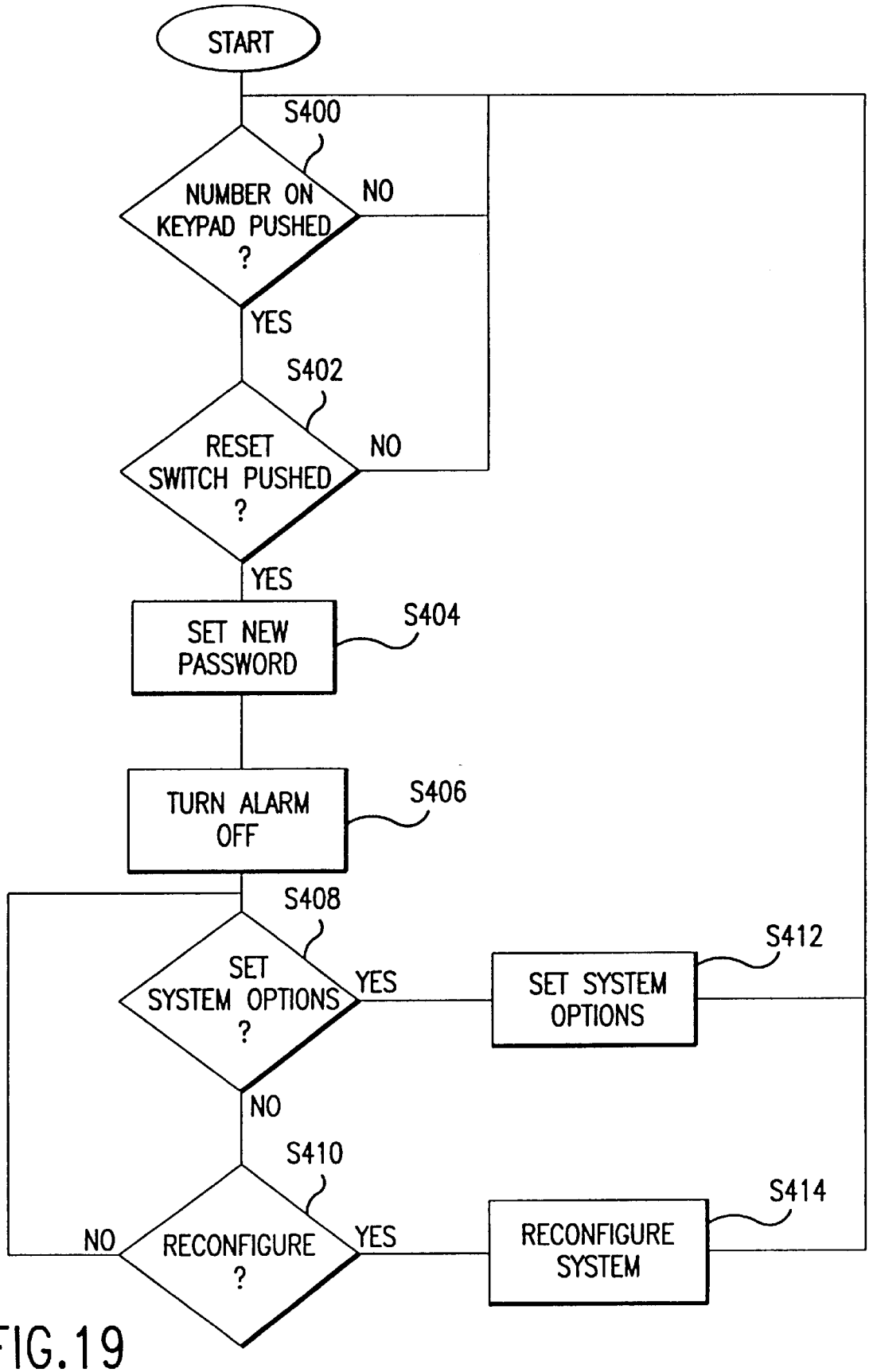
FIG. 19 is a flowchart of the reset switch process.

In step S110, the controller 308 starts three concurrent processes. The flow chart for the keypad scan process is shown in FIG. 15, the flow chart for the sensor scan process is shown in FIG. 18 and the flow chart for reset switch scan is shown in FIG. 19. After starting the three concurrent processes, the controller 308 continues to step S104.

In step S104, the controller 308 checks if an operator has armed the security system 100. If the operator has not armed the security system 100, the controller 308 jumps to step S106; otherwise, the controller 308 goes to step S108.

In step S106, the controller 308 checks if a rearm timer set to a predetermined amount of time has expired. If the timer has not expired, the controller 308 returns to step S104. However, if the timer has expired, the controller 308 goes to step S108.

In step S108, the controller 308 arms the security system 100. When the security system 100 is armed, all the alarms of the security system 100 are enabled to sound based on the occurrence of alarm events. When the security system 100 is disarmed, the alarms of the security system 100 will not sound even though an alarm event occurs. However, the security system 100 continues to scan all the sensors for alarm events independent of whether the security system 100 is armed or disarmed.

FIG. 15 is a flow chart of the key scan process. After the key scan process is started by the controller 308 at step S110, the controller 308 goes to step S200. In step S200, the controller 308 checks if any key of the keypad 304 is depressed. If none of the keys is depressed, the controller 308 returns to step S200 and checks if a key is depressed again. If a key on the keypad 304 is depressed, the controller 308 goes to step S202.

In step S202, the controller 308 verifies if the first four numeric key entries form a correct password. If the first four numeric key entries do not match the correct password, the controller 308 goes to step S206. If the first four numeric key entries match the correct password, the controller 308 jumps to step S204.

In step S206, the controller 308 increments a password attempt counter. Then, the controller 308 goes to step S201 where the controller 308 checks if the password attempt counter exceeded a preset limit. If the password attempt counter does not exceed the preset number, the controller 308 returns to step S200; otherwise, the controller 308 goes to step S214.

In step S214, the controller 308 sounds a warning signal. Then, the controller 308 goes to step S216. In step S216, the controller 308 resets the password attempt count to 0 and goes to step S218.

In step S218, the controller 308 waits for a preset amount of time. After the preset amount of time expires, the controller 308 stops the warning signal, and returns to step S200.

In step S204, the controller 308 checks if there were any alarm events that occurred during a previous predetermined period of time. If there were no alarm events that occurred during this previous predetermined period of time, the controller 308 goes to step S212; otherwise, the controller goes to step S208.

Figure 16:
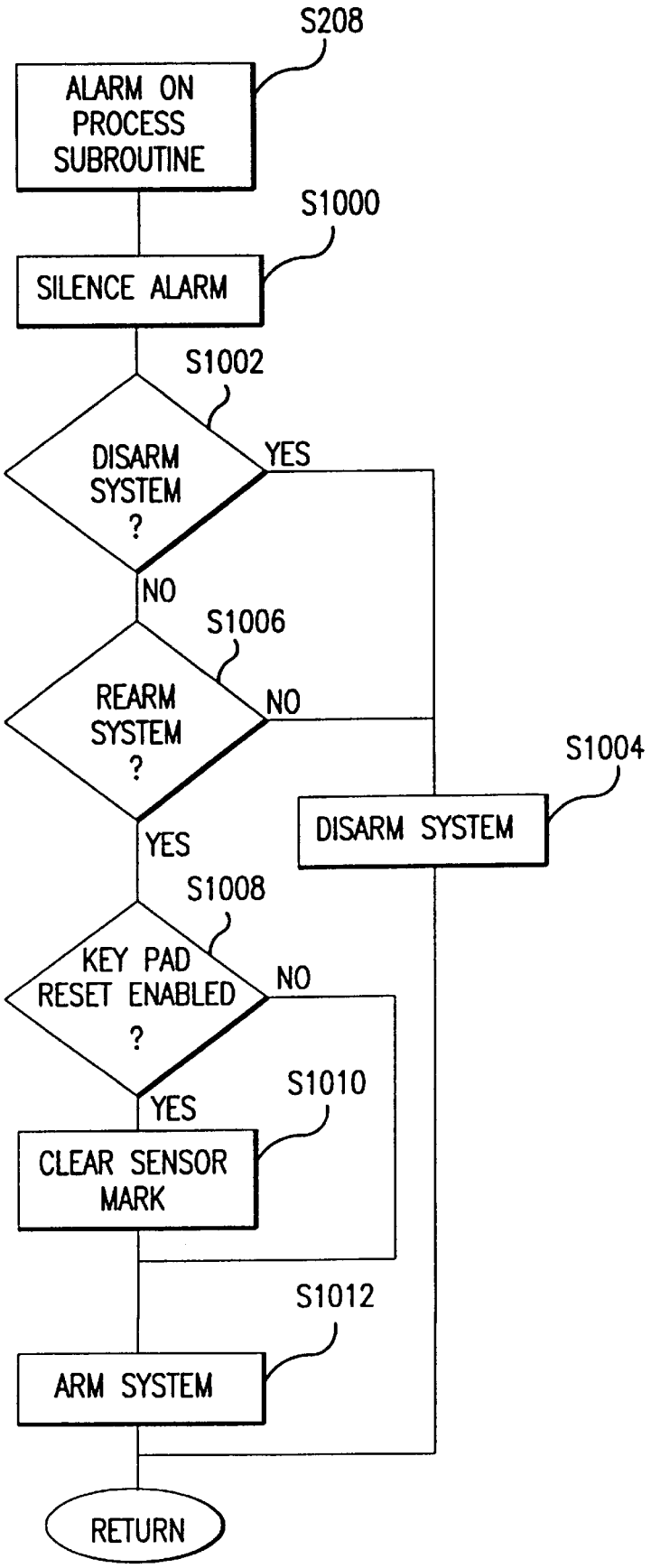
FIG. 16 is a flowchart of the alarm ON process subroutine shown in FIG. 15.

In step S208, the controller 308 performs the alarm ON process shown in FIG. 16. In step S212, the controller 308 performs the alarm OFF process shown in FIG. 17.

FIG. 16 shows the alarm ON process in greater detail. When the controller 308 starts the alarm ON process, the controller 308 goes to step S1000. In step S1000, the controller 308 silences the main alarm 310. Then the controller 308 goes to step S1002.

In step S1002, the controller 308 checks if an operator desires to disarm the security system 100 by depressing the "*" key on the keypad 304. If the "*" on the keypad 304 was pressed, the controller 308 goes to step S1004; otherwise, the controller goes to step S1006.

In step S1004, the controller 308 disarms the security system 100. Then the controller 308 returns and goes to step S200.

In step S1006, the controller 308 checks if the "#" key was pressed. If the "#" key was not pressed, then the controller 308 goes to step S1004; otherwise, the controller 308 goes to step S1008. In step S1004, the controller 308 disarms the security system 100 and returns to step S200.

In step S1008, the controller 308 checks if the keypad reset option is enabled. If the keypad reset option is not enabled, then the controller 308 jumps to step S1012; otherwise, the controller 308 goes to step S1010.

In step S1010, the controller 308 clears a sensor mark. The sensor mark is an indicator in the controller memory maintained by the controller 308 to indicate that a corresponding sensor had generated an alarm event during the previous predetermined period of time. After clearing this sensor mark, the memory of prior alarm events generated by the corresponding sensor is removed. However, if the sensor mark is not cleared, the controller 308 continues to remember that an alarm event was generated by the corresponding sensor 202.

In step S1012, the controller 308 arms the security system 100 and then returns to step S200.

Figure 17:
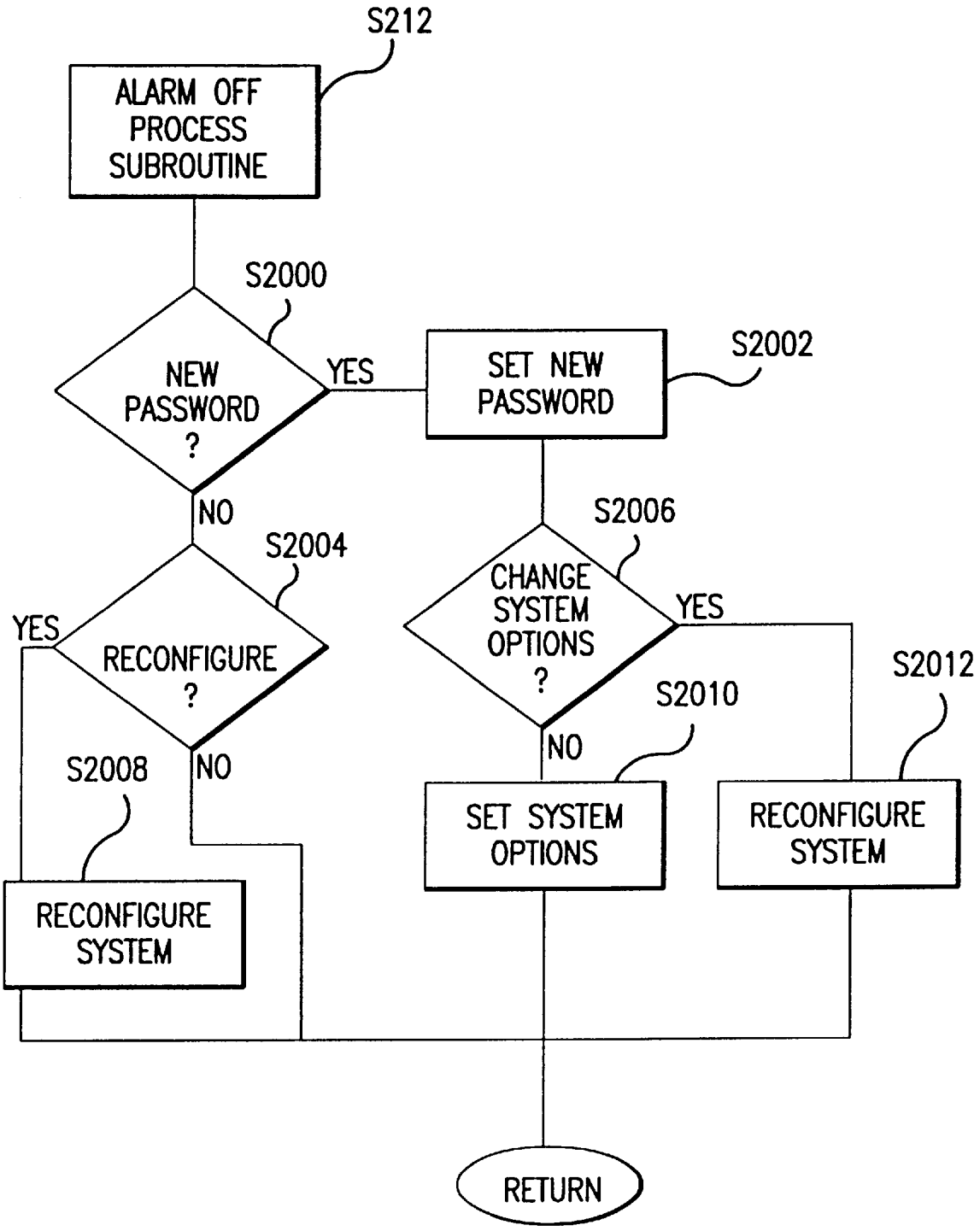
FIG. 17 is a flowchart of the alarm OFF process subroutine shown in FIG. 15.

FIG. 17 shows the flow chart of the alarm OFF process subroutine in greater detail. When step S212 is entered, the controller 308 goes to step S2000. In step S2000, the controller 308 checks if the "0" key is pressed indicating that the operator desires to set a new password. If the key "0" is pressed, the controller 308 goes to step S2002; otherwise, the controller 308 goes to step S2004.

In step S2002, the controller 308 allows the operator to set a new password. Then the controller goes to step S2006. In step S2006, the controller 308 checks if "8" is pressed indicating that the operator desires to reconfigure the system. If the key "8" is pressed, the controller 308 goes to step S2012; otherwise, the controller 308 goes to step S2010.

In step S2010, the controller 308 sets the system options shown in Table 1 above based on operator inputs through the keypad 304. After the system options are set, the controller 308 returns to step S200.

In step S2012, the controller 308 reconfigures the security system 100. After the security system 100 is reconfigured, the controller 308 returns to step S200.

In step S2004, the controller 308 checks if key "8" is pressed to indicate the desire to reconfigure the system. If the key "8" is pressed, the controller 308 goes to step S2008; otherwise, the controller 308 returns to step S200. In step S2008, the controller reconfigures the security system and then returns to step S200.

FIG. 18 shows the flow chart for the sensor scan process. After the controller 308 starts the sensor scan process in step Sl0, the controller 308 goes to step S300. In step S300, the controller 308 polls all the sensors of the current security system configuration by scanning control and sensor data signals through the shift registers 422 and 424 of each hub 400 and receiving sensor status back from the input shift registers 424 of the hubs 400. Based on the data returned from the sensors 200, the controller 308 determines whether any new alarm events have occurred since the last polling period. After the controller 308 scans the sensors 200, the controller 308 goes to step S302.

In step S302, the controller 308 checks if any new alarm events have occurred. A new alarm event occurs when a sensor generates an alarm event that is detected by the controller 308 for the first time. If new alarm events have occurred, the controller goes to step S306; otherwise, the controller goes to step S304.

In step S306, the controller 308 sets the sensor marks corresponding to each sensor that is generating a new alarm event. Once set, the sensor mark is not removed until the operator consciously resets the sensor mark by using the keypad reset feature or using the hub reset switch 408. After the controller 308 sets the sensor marks, the controller 308 goes to step S310.

In step S310, the controller 308 checks if the security system 100 is armed. If the controller system 100 is armed, then the controller 308 goes to step S314; otherwise, the controller 308 goes to step S311.

In step S314, the controller 308 stops any hub annunciations and sounds the main alarm 310. After sounding the main alarm 310, the controller 308 returns to step S300 and repeats the sensor scan process.

In step S304, the controller 308 checks if a rearm timer has expired. The rearm timer is set to a predetermined period of time after a current alarm is silenced. If the predetermined period of time expires, the controller 308 goes to step S305; otherwise, the controller 308 goes to step S308.

When one of the sensors 200 generates an alarm event, the controller 308 marks the sensor by setting a sensor mark and an old alarm event flag corresponding to the sensor 200. After the operator disarms the security system, the controller 308 sounds the hub annunciator 412. The operator then has the option of either resetting the hub annunciator 412 by using the keypad reset option or going to the hub physical location and depressing the hub reset switch 408. When the hub annunciator 412 is reset by either of the above methods, the sensor mark is reset, however, the old alarm event flag is still set. When the controller 308 reaches step S302 and checks for new alarm events, the controller 308 compares the current alarm event status with the old alarm event flag for each sensor 200 in the security system configuration. If a sensor 200 is generating a current alarm event and the old alarm event flag is set, then this alarm event is not new. However, if the old alarm event flag is not set, then the current alarm event is new and the controller 308 goes to step S306 and sets the sensor mark corresponding to the sensor.

In step S305, the controller 308 clears all the old alarm event flags for all the sensors 200 that are in the security system's current configuration, arms the security system 100 and returns to step S300. Thus, when the controller 308 reaches step S306, all alarm events are considered new and the security system 100 is armed. Accordingly, the main alarm 310 will be sounded at step S314 when any alarm event is detected.

In step S308, the controller 308 checks if the main alarm 310 is currently sounding. If the main alarm 310 is currently sounding, then the controller 308 returns to step S300; otherwise, the controller 308 goes to step S311. In step S311, the controller 308 checks if any sensor marks are set. If no sensor marks are set, then the controller 308 returns to step S300; otherwise, the controller 308 goes to step S312.

In step S312, the controller 308 activates the next hub annunciator 412. The hub annunciator 412 is not activated unless the main alarm 310 is silenced. Thus, when an alarm event occurs, the controller 308 sounds the main alarm 310. The operator responds by entering the password which is processed by the controller 308 in step S202. The controller 308 will follow the process shown in FIG. 15 and come to step S1000 shown in FIG. 16. The controller 308 silences the alarm in step S1000 and if the operator chooses, the controller 308 disarms the system in step S1004. Accordingly, when the scanned sensor process comes to step S310, the security system 100 is disarmed allowing the controller 308 to activate the hub annunciator 412 in step S312. After the controller 308 sounds the hub annunciator 412, the controller 308 goes to step S316.

In step S316, the controller 308 waits for a predetermined amount of time. This time is set so that the hub annunciator 412 cannot be reset immediately after it begins to sound. This prevents a knowledgeable thief from silencing the hub annunciator 412 immediately while the operator is still at the control unit location. After the step S316, the controller 308 goes to step S318.

In step S318, the controller 308 checks if the operator desires to reset hub annunciator 412. The hub annunciator 412 can be reset by either pressing the reset switch 408 or by using the keypad reset feature if enabled. If the hub annunciator 412 is not reset, the controller 308 returns to step S300 leaving the hub annunciator 412 activated; otherwise, the controller 308 goes to step S320.

In step S320, the controller 308 deactivates the hub annunciator 412. Then the controller 308 goes to step S322. In step S322, the controller 308 clears the sensor mark corresponding to the sensor that caused the alarm event associated with the specific sensor at the hub 400 activating the hub annunciator 412. After step S322, the controller 308 returns to step S300.

Therefore, the controller 308 will process steps S311, S312, S316, S318, S320 and S322 until all the sensor marks are cleared. This process encourages the operator to deal with each alarm event until all the alarm events are intentionally reset and the condition causing each alarm event is corrected.

If the predetermined time period of step S304 expires before all the sensor marks are cleared, then the main alarm 310 will be sounded by step S314. However, the sensor marks will be set again unless the corresponding sensor stops generating alarm events. Thus, after the second sounding of the main alarm 310 is stopped and the security system 100 is disarmed, the controller 308 returns to step S311 and continues to activate the hub annunciators 412 until all the sensor marks are cleared.

FIG. 19 shows the flow chart for the reset switch scan process. After the controller 308 starts the reset switch scan process in step S110, the controller 308 goes to step S400. In step S400, the controller 308 checks if a numeral key on the keypad 304 is pressed. If a numeral key is not pushed, the controller 308 returns to step S400. If a numeral key is pressed, the controller 308 goes to step S402.

In step S402 the controller 308 checks if the reset switch 312 is pressed. If the reset switch 312 is not pressed, the controller 308 returns to step S400. Concurrently, the controller 308 processes the keypad scan process shown in FIG. 15. While the reset switch scan process returns to step S400, the controller 308 goes to step S202 in the key scan process and checks to see if the keystrokes entered a correct password. If the reset switch 312 is pressed, the controller 308 goes to step S404.

In step S404, the controller 308 sets the new password based on the operator keypad entries. The controller 308 does not compare the entered password with a correct password. Rather, the controller 308 enters the keystrokes as the new password. After the password is set, the controller 308 goes to step S406.

In step S406, the controller 308 silences the main alarm 310 and goes to step S408. In step S408, the controller 308 checks if the operator desires to set the system options. If the operator desires to set the system options, the controller 308 goes to step S412, otherwise, the controller goes to step S410.

In step S412 the controller 308 enables the operator to set the system options. After the operator sets the system options, the controller 308 returns to step S400.

In step S410, the controller 308 checks if the operator desires to reconfigure the system. If the operator desires to reconfigure the system, the controller 308 goes to step S414; otherwise, the controller returns to step S408.

In step S414, the controller 308 reconfigures the system. After the system is reconfigured, the controller 308 returns to step S400.

While this invention has been described in conjunction with specific embodiments thereof, it is evident that many alternatives, modifications and variations will be apparent to those skilled in the art.

In particular, hubs 400 need not be used to group sensors 200 locally. The hub annunciator functions can be performed by either the main alarm 310 or any number of other alarms or annunciators. The sensors 200 can be connected directly to the control unit 300 and the locations of each sensor generating alarm events could be simply the sensor number.

Further, the main alarm 310 and the hub annunciator 412 need not be audible. Any indicator indicating that an alarm event occurred is sufficient for a main alarm 310 and any indicator at the hubs 400 that identifies the specific sensor 200 that generated an alarm event is sufficient for a hub annunciator 412. Thus activating and re-activating the main alarm and hub annunciators 310 and 412, respectively is equivalent to sounding these alarms/indicators/annunciators.

Accordingly, the preferred embodiments of the invention as set forth herein are intended to be illustrative, not limiting. Various changes may be made without departing from the spirit and scope of the invention as defined in the following claims.

What is claimed is:

1. A method for operating a merchandise security system wherein a plurality of sensors are attached to a plurality of objects to be secured, a set of sensors within the plurality of sensors being connected to a corresponding hub, each hub being connected to a security system controller, each sensor or hub generating an alarm event when separated from the controller or object to be secured, the method comprising the steps of:

activating the controller to sense alarm events;

generating an alarm event when at least one sensor or hub is separated from the controller or object to be secured;

storing a location of a sensor or hub generating an alarm event; and displaying the location of the sensor or hub generating the alarm event at the controller.

2. The method of claim 1, wherein the sensors connected to a hub are each assigned a separate sensor number and the hubs connected to the controller are each assigned a separate hub number, and wherein the step of displaying the location includes the step of indicating at least one of the hub number and the number of the sensor generating the alarm event at the controller.

3. The method of claim 1, wherein the controller includes a display unit and the step of indicating at least one of the sensor and hub numbers includes the step of displaying at least one of the sensor and hub numbers on the display unit at the controller.

4. The method of claim 1, wherein the step of storing the location of the sensor or hub includes the step of using a microprocessor to store the location.

5. The method of claim 4, wherein the microprocessor is located in the controller.

6. The method of claim 1, further comprising the steps of:

arming a main alarm to trigger an alarm signal when an alarm event is detected;

triggering the alarm signal when an initial alarm event is detected;

disarming the main alarm to deactivate the alarm signal;

re-arming the main alarm to trigger the alarm signal when a subsequent alarm event is detected while continuing to store the location of the sensor or hub generating the initial alarm event.

7. The method of claim 6, wherein the steps of disarming and re-arming are performed at the controller.

8. A method for operating a merchandise security system wherein a plurality of sensors are attached to a plurality of objects to be secured, a set of sensors within the plurality of sensors being connected to a corresponding hub, each hub being connected to a security system controller, each sensor or hub generating an alarm event when separated from the controller or object to be secured, the method comprising the steps of:

activating the controller to sense alarm events;

arming a main alarm to trigger an alarm signal when an alarm event is detected;

generating an alarm event when at least one sensor or hub is separated from the controller or object to be secured;

storing a location of a sensor or hub generating an initial alarm event;

triggering the alarm signal when the initial alarm event is detected;

disarming the main alarm to deactivate the alarm signal;

re-arming the main alarm to trigger the alarm signal when a subsequent alarm event is detected while continuing to store the location of the sensor or hub generating the initial alarm event.

9. The method of claim 8, wherein the steps of disarming and re-arming are performed at the controller.

10. The method of claim 8, wherein the controller stores the location of the sensor or hub generating the alarm event.

11. The method of claim 8, wherein the subsequent alarm event is generated by the sensor or hub that generated the initial alarm event.

12. The method of claim 8, wherein the subsequent alarm event is generated by a sensor or hub other than the sensor or hub that generated the initial alarm event.

13. A method for operating a merchandise security system wherein a plurality of sensors are attached to a plurality of objects to be secured, said sensors being connected to a security system controller, each sensor generating an alarm event when separated from the controller or object to be secured, the method comprising the steps of:

activating the controller to sense alarm events;

generating an alarm event when at least one sensor is separated from the controller or object to be secured; and storing an identifier of a sensor generating an alarm event using a microprocessor.

14. The method of claim 13, further comprising the step of immediately after storing the identifier of the sensor generating an initial alarm event, maintaining the controller in a condition to sense subsequent alarm events while continuing to store the location of the sensor generating the initial alarm event.

15. The method of claim 13, further comprising the step of:

displaying the identifier of the sensor generating the alarm event at the controller.

16. The method of claim 13, wherein the microprocessor is located within the controller.

17. The method of claim 13, wherein each of said sensors includes an indication signal indicating that the sensor is capable of generating an alarm event if separated from the controller or object to be secured;

the indication signals on all of the sensors except for the sensor generating the alarm event being deactivated automatically by the controller upon the generation of the alarm event.

18. A method for operating a merchandise security system wherein a plurality of sensors are attached to a plurality of objects to be secured, the sensors being connected to a security system controller, each sensor generating an alarm event when separated from the controller or object to be secured, the method comprising the steps of:

activating the controller to sense alarm events;

arming a main alarm to trigger an alarm signal when an alarm event is detected;

generating an alarm event when at least one sensor is separated from the controller or object to be secured;

storing a location of the sensor generating the alarm event;

disarming the main alarm while continuing to store the location of the sensor generating the alarm event; and retriggering the main alarm if a condition causing the alarm event is not corrected and a predetermined period of time has elapsed.

19. A method for operating a merchandise security system wherein a plurality of sensors are attached to a plurality of objects to be secured, and sensors being connected to a security system controller, each sensor generating an alarm event when separated from the controller or object to be secured, the method comprising the steps of:

activating the controller to sense alarm events;

arming a main alarm to trigger an alarm signal when an alarm event is detected;

generating an alarm event when a sensor is separated from the controller or object to be secured;

storing an identifier of a sensor generating an initial alarm event;

triggering the alarm signal when the initial alarm event is detected;

disarming the main alarm to deactivate the alarm signal; and re-arming the main alarm to trigger the alarm signal when a subsequent alarm event is detected while continuing to store the identifier of the sensor generating the initial alarm event.

20. The method of claim 19, further including:

displaying the identifier of the sensor generating the initial alarm event;

correcting a condition causing the initial alarm event; and displaying an identifier of a sensor generating the subsequent alarm event in place of the identifier of the sensor generating the initial alarm event.

21. The method of claim 19, wherein each of the sensors includes an indication signal indicating that the sensor is capable of generating an alarm event;

the indication signals on all of the sensors except for the sensor generating the initial alarm event being deactivated automatically by the controller upon the generation of the initial alarm event.

22. The method of claim 19, wherein said arming and disarming steps are performed by entering a code at said controller.

23. The method of claim 22, further including:

changing said code by accessing a reset button mounted within said controller by disassembling said controller;

depressing said reset button; and entering a sequence of characters on a keypad of said controller.

24. A method for operating a merchandise security system wherein a plurality of sensors are attached to a plurality of objects to be secured, the sensors being connected to a security system controller, each sensor generating an alarm event when separated from the controller or object to be secured, the method comprising the steps of:

configuring the security system to determine a current system configuration by storing a current number of sensors attached to the controller;

activating the controller to sense alarm events and changes within the current system configuration;

automatically reconfiguring the current system configuration to an updated system configuration whenever additional sensors are connected to the controller; and continuing to sense alarm events and changes within the updated system configuration.

25. The method of claim 24, wherein the controller has a plurality of sensor inputs, the controller configuring the system to recognize open sensor inputs when the current number of sensors attached to the controller is less than the plurality of sensor inputs.

26. A method for operating a merchandise security system wherein a plurality of sensors are attached to a plurality of objects to be secured, the sensors being connected to a security system controller, each sensor generating an alarm event when separated from the controller or object to be secured, the method comprising the steps of:

configuring the security system to determine a current system configuration by storing a current number of sensors attached to the controller;

activating the controller to sense alarm events and changes within the current system configuration;

arming a main alarm to trigger an alarm signal when an alarm event is detected;

storing a location of a sensor generating an alarm event;

determining whether there are any stored alarm events;

disarming the main alarm when there are no stored alarm events;

changing the location of sensors attached to the controller or reducing the number of sensors;

reconfiguring the system to determine an updated system configuration by storing the changed number of sensors and the location of each sensor; and re-arming the main alarm to trigger the alarm signal when alarm events are detected within the updated system configuration.

27. The method of claim 26, further comprising the step of prohibiting the step of disarming the main alarm when there are stored alarm events.

28. A method for operating a merchandise security system wherein a plurality of sensors are attached to a plurality of objects to be secured, the sensors within the plurality of sensors being connected to a security system controller, each sensor generating an alarm event when separated from the controller or object to be secured, the method comprising the steps of:

activating the controller to sense alarm events;

arming a main alarm to trigger an alarm signal when an alarm event is detected;

generating an alarm event when at least one sensor is separated from the controller or object to be protected, thereby activating the main alarm;

storing a location of the sensor generating the alarm event;

activating an indication signal on each of the plurality of sensors after the controller is activated; and deactivating the indication signals on all sensors except for the indication signal on the sensor that generated the alarm event.

29. A method for operating a merchandise security system wherein a plurality of sensors are attached to a plurality of objects to be secured, the sensors being connected to a security system controller, each sensor generating an alarm event when separated from the controller or object to be secured, the method comprising the steps of:

activating the controller to sense alarm events; and indicating that a sensor is capable of generating an alarm event by activating an indication signal on the sensor, the indication signal being a sequence of signals, the number of signals within the sequence indicating a location of the sensor.

30. The method of claim 29, wherein the indication signal is a visual signal, and the sequence of signals is a flashing sequence of the indicator signal.

31. A merchandise security system comprising:

a controller for sensing alarm events;

one or more hubs connected to the controller;

a plurality of sensors capable of attachment to a plurality of objects to be secured, a set of sensors within the plurality of sensors being attached to a corresponding hub, each sensor or hub generating an alarm event when separated from the controller or object to be secured;

wherein the controller stores the location of the sensor or hub generating the alarm event and displays the location of the sensor or hub generating the alarm event at the controller.

32. The system of claim 31, wherein the sensors connected to a hub are each assigned a separate sensor number and the hubs connected to the controller are each assigned a separate hub number, and wherein the controller indicates at least one of the hub number and the number of the sensor generating the alarm event at the controller.

33. The system of claim 32, wherein the controller includes a display unit which displays at least one of the sensor and hub numbers on the display unit at the controller.

34. The system of claim 31, wherein the controller includes a microprocessor to store the location.

35. The system of claim 34, wherein the microprocessor is located in the controller.

36. The system of claim 31, wherein the controller arms a main alarm to trigger an alarm signal when an alarm event is detected; triggers the alarm signal when an initial alarm event is detected; allows an operator to disarm the main alarm to deactivate the alarm signal; and allows an operator to re-arm the main alarm to trigger the alarm signal when a subsequent alarm event is detected while continuing to store the location of the sensor or hub generating the initial alarm event.

37. The system of claim 36, wherein the disarming and re-arming are performed by the operator at the controller.

38. A merchandise security system comprising:

a controller for sensing alarm events;

one or more hubs connected to the controller;

a plurality of sensors capable of attachment to a plurality of objects to be secured, a set of sensors within the plurality of sensors being attached to a corresponding hub, each sensor or hub generating an alarm event when separated from the controller or object to be secured;

wherein the controller arms a main alarm to trigger an alarm signal when an alarm event is detected; stores a location of a sensor or hub generating an initial alarm event; triggers the alarm signal when the initial alarm event is detected; allows an operator to disarm the main alarm to deactivate the alarm signal; and allows an operator to re-arm the main alarm to trigger the alarm signal when a subsequent alarm event is detected while continuing to store the location of the sensor or hub generating the initial alarm event.

39. The system of claim 38, wherein the disarming and re-arming are performed by the operator at the controller.

40. The system of claim 38, wherein the controller stores the location of the sensor or hub generating the alarm event.

41. The system of claim 38, wherein the subsequent alarm event is generated by the sensor or hub that generated the initial alarm event.

42. The system of claim 38, wherein the subsequent alarm event is generated by a sensor or hub other than the sensor or hub that generated the initial alarm event.

43. A merchandise security system comprising:

a controller for sensing alarm events;

a plurality of sensors capable of attachment to the controller and a plurality of objects to be secured, each sensor generating an alarm event when separated from the controller or object to be secured;

wherein the controller includes a microprocessor for storing a location of an initial sensor generating an alarm event and for continuing to sense subsequent alarm events while continuing to store the location of the initial sensor.

44. A merchandise security system comprising:

a controller for sensing alarm events;

a plurality of sensors capable of attachment to the controller and a plurality of objects to be secured, each sensor generating an alarm event when separated from the controller or object to be secured;

wherein the controller triggers a main alarm upon detecting an alarm event, stores the location of the sensor generating the alarm event, and re-triggers the main alarm if a condition causing the alarm event is not corrected and a predetermined period of time has elapsed.

45. A merchandise security system comprising:

a controller for sensing alarm events;

a plurality of sensors attached to a plurality of objects to be secured, and connected to the security system controller, each sensor generating an alarm event when separated from the controller or object to be secured;

wherein the controller arms a main alarm to trigger an alarm signal when an alarm event is detected; stores an identifier of a sensor generating an initial alarm event; triggers the alarm signal when the initial alarm event is detected; allows an operator to disarm the main alarm to deactivate the alarm signal; and allows the operator to re-arm the main alarm to trigger the alarm signal when a subsequent alarm event is detected while continuing to store the identifier of the sensor generating the initial alarm event.

46. A merchandise security system comprising:

a controller for sensing alarm events;

a plurality of sensors capable of attachment to the controller and a plurality of objects to be secured, each sensor generating an alarm event when separated from the controller or object to be secured;

wherein the controller configures the security system to determine a current system configuration by storing a current number of sensors and a location of each sensor; the controller sensing alarm events and changes within the current system configuration; and the controller automatically reconfiguring the current system configuration to an updated system configuration whenever additional sensors are added, the controller continuing to sense alarm events and changes within the updated system configuration.

47. A merchandise security system comprising:

a controller for sensing alarm events;

a plurality of sensors capable of attachment to the controller and a plurality of objects to be secured, each sensor generating an alarm event when separated from the controller or object to be secured;

wherein the controller: configures the security system to determine a current system configuration by storing a current number of sensors and a location of each sensor; arms a main alarm to trigger an alarm signal when an alarm event is detected; stores a location of a sensor generating an alarm event; and allows disarming of the main alarm and reconfiguring of the current system configuration to an updated system configuration when there are no stored alarm events and when the location of a sensor is changed or the number of sensors has been reduced from the current system configuration.

48. A merchandise security system comprising:

a controller for sensing alarm events;

a plurality of sensors capable of attachment to the controller and a plurality of objects to be secured, each sensor generating an alarm event when separated from the controller or object to be secured;

wherein the controller stores a location of the sensor generating an alarm event; and an alarm signal is activated when an alarm event is detected;

wherein each sensor includes an indication signal indicating that the sensor is capable of generating an alarm event, the indication signal on all sensors being deactivated when the alarm signal is activated, except for the sensor that generated the alarm event.

* * * * *

UNITED STATES PATENT AND TRADEMARK OFFICE

CERTIFICATE OF CORRECTION

PATENT NO. : 6,278,365 B1
DATED : August 21, 2001
INVENTOR(S) : Kane et al.

It is certified that error appears in the above-identified patent and that said Letters Patent is hereby corrected as shown below:

Column 17,
Line 1, please change “claim 1” to -- claim 2 --.

Signed and Sealed this

Eighth Day of October, 2002

*Attest:*

*Attesting Officer*

JAMES E. ROGAN
*Director of the United States Patent and Trademark Office*